US009108204B1

(12) United States Patent
Poo et al.

(10) Patent No.: US 9,108,204 B1
(45) Date of Patent: Aug. 18, 2015

(54) CENTRIFUGE WITH CONTINUOUS FLUID FLOW FOR CONTAINERS

(71) Applicant: Biorep Technologies, Inc., Miami, FL (US)

(72) Inventors: Ramon E Poo, Miami, FL (US); Felipe Echeverri, Miami, FL (US)

(73) Assignee: BIOREP TECHNOLOGIES, INC., Miami, FL (US)

( * ) Notice: Subject to any disclaimer, the term of this patent is extended or adjusted under 35 U.S.C. 154(b) by 0 days.

(21) Appl. No.: 14/302,076

(22) Filed: Jun. 11, 2014

(51) Int. Cl.
*B04B 5/04* (2006.01)
*B04B 9/10* (2006.01)

(52) U.S. Cl.
CPC ..... *B04B 9/10* (2013.01); *B04B 2005/0492* (2013.01)

(58) Field of Classification Search
CPC ..... B04B 2005/0492
USPC ..... 494/21, 45, 83, 84, 17–19, 47; 210/380.1, 380.3, 781, 782; 138/111
See application file for complete search history.

(56) References Cited

U.S. PATENT DOCUMENTS 3,850,368 A * 11/1974 Boeckeler ..... 425/430
3,986,442 A * 10/1976 Khoja et al. ..... 475/182
4,056,224 A * 11/1977 Lolachi ..... 494/18
4,108,353 A * 8/1978 Brown ..... 494/18
4,109,852 A * 8/1978 Brown et al. ..... 494/18
4,109,854 A * 8/1978 Brown ..... 494/18
4,109,855 A * 8/1978 Brown et al. ..... 494/18
4,111,356 A * 9/1978 Boggs et al. ..... 494/18
4,113,173 A * 9/1978 Lolachi ..... 494/18
4,114,802 A * 9/1978 Brown ..... 494/18
4,120,449 A * 10/1978 Brown et al. ..... 494/18
4,164,318 A * 8/1979 Boggs ..... 494/18
4,194,684 A * 3/1980 Boggs ..... 494/18
4,296,882 A * 10/1981 Kobayashi ..... 494/18
4,874,358 A * 10/1989 Brimhall et al. ..... 494/37
5,151,368 A * 9/1992 Brimhall et al. ..... 435/286.7
6,589,153 B2 * 7/2003 Dolecek et al. ..... 494/18
8,727,958 B2 * 5/2014 Schimmelpfennig et al. .. 494/18

* cited by examiner

*Primary Examiner* — Charles Cooley
(74) *Attorney, Agent, or Firm* — Novak Druce Connolly Bove + Quigg LLP

(57) ABSTRACT

A centrifuge includes a container and at least one drive for rotating the container about its own axis and revolving the container about an axis of revolution and through a plane of revolution. At least one conduit extends from the container to a first or second side of the plane of revolution. The direction of rotation of the container is according to the left hand rule if the conduit extends to the first side of the plane of rotation, and according to the right hand rule if the conduit extends to the second side of the plane of rotation. The frequency of the container rotation is equal to the frequency of the container revolution. A centrifugal separator and a method for centrifuging a liquid are also disclosed. The invention provides for continuous centrifugation while prevent conduits into the container from getting tangled.

5 Claims, 36 Drawing Sheets

DETAIL "A"

CENTRIFUGE WITH CONTINUOUS FLUID FLOW FOR CONTAINERS

FIELD OF THE INVENTION

This invention relates generally to centrifuges, and methods and apparatus for centrifugation.

BACKGROUND OF THE INVENTION

Centrifugation is a process in which a centrifugal force is applied to a fluid to separate components based upon their density. The more dense components of a mixture migrate away from the axis of centrifuge and away from the less dense components. Centrifugation is accomplished by a centrifuge typically having a rotating platform on which are secured a plurality of sealed containers or test tubes which contain the liquids of interest. The platform is typically rotated at a very high rate in the hundreds or even thousands of revolutions per minute (RPM). Centrifugation is therefore most commonly a batch process. Liquids are placed into the containers, which are sealed and placed into the centrifuge and then the centrifuge is activated to perform the centrifugation. The containers are then removed from the centrifuge to permit the selective withdrawal of the separated components as by a pipette. The high rate of revolution of the centrifuge usually renders non-batch centrifugation impractical.

SUMMARY OF THE INVENTION

A centrifuge includes a container and at least one drive for rotating the container about its own axis and revolving the container about an axis of revolution and through a plane of revolution. At least one conduit extends from the container to a first or second side of the plane of revolution. The direction of rotation of the container is according to the left hand rule if the conduit extends to the first side of the plane of rotation, and according to the right hand rule if the conduit extends to the second side of the plane of rotation. The frequency of the container rotation is equal to the frequency of the container revolution.

The centrifuge can further include a second fluid conduit extending into the container. The first fluid conduit can introduce fluid into the container, and the second fluid conduit can remove fluid from the container. The first fluid conduit and the second fluid conduit have proximal ends that are fixed in space relative to the rotation and revolution of the container.

The centrifuge can also include a bearing seal. The first and second fluid conduits can be connected to the bearing seal. The bearing seal can be rotatably mounted to the container.

The centrifuge can also include a container support. The container can be rotatably mounted to the container support. The container support can be a plate, and the plane of revolution can be defined by the plate. The plate can comprise a bevel portion. The container can be rotatably mounted to the bevel portion.

The first and second conduits can extend from a first side of a plane of revolution of the container. A tangent to the rotation of the container on the first side farthest from the plane of revolution of the container can have a direction that is opposite to the direction of a tangent to revolution of the container.

The first and second conduits can have openings in the container. A drive for changing the position of the openings in the container can be provided. The centrifuge can further include at least one sensor for sensing a characteristic of the fluid in the container and generating a signal. A processor can be provided for processing the signal and directing the drive for changing the position of the conduit openings in the container responsive to the signal.

The centrifuge can include a separation device having sides for separating fluid components in the container according to at least one characteristic of the fluids. One of the fluid conduits supplies fluid to one side of the separation device and the other of the fluid conduits removes at least one component of the fluid from the other side of the separation device. The separation device can be a filter.

The centrifuge can have a counterweight positioned opposite to the container relative to the axis of revolution of the container. The position of the counterweight can be adjustable.

The container can be rotatably mounted to a support and fixedly mounted to a distal end of a double universal joint. A proximal end of the double universal joint can be fixed in space relative to the rotation and revolution of the container.

A centrifuge according to the invention can include a container and at least one drive for rotating the container about its own axis and revolving the container about an axis of revolution and through a plane of revolution. At least one conduit extends from the container to a first side of the plane of revolution. The direction of a tangent to the rotation of the container on the first side farthest from the plane of revolution of the container has a direction that is opposite to a tangent to the direction of revolution of the container.

A centrifuge can include a container and at least one drive for rotating and revolving the container. The direction of a tangent to the rotation of the container is opposite to the direction of a tangent to the revolution of the container. The container is rotatably mounted to a support and fixedly mounted to a distal end of a double universal joint. A proximal end of the double universal joint can be fixed in space relative to the rotation and revolution of the container. The frequency of the container rotation can be equal to the frequency of the container revolution. The centrifuge can include a first fluid conduit extending into the container, and can further include a second fluid conduit extending into the container. The first fluid conduit can introduce fluid into the container, and the second fluid conduit can remove fluid from the container.

A centrifugal separator can include a container and at least one drive for rotating and revolving the container. The direction of a tangent to the rotation of the container can be opposite to the direction of a tangent to the revolution of the container. First and second fluid conduits can extend into the container. A separation device in the container can have sides for separating fluid components in the container according to at least one characteristic of the fluids. One of the fluid conduits can supply fluid to one side of the separation device and the other of the fluid conduits can remove at least one component of the fluid from the other side of the separation device. The separation device can be a filter. The frequency of rotation of the container can be equal to the frequency of revolution of the container.

A method of centrifuging a fluid can include the steps of positioning the fluid in a container, and rotating the container about its own axis and revolving the container about an axis of revolution and through a plane of revolution. The liquid can be conducted through at least one conduit extending from the container. The conduit can be positioned on a first or second side of the plane of revolution. The direction of rotation of the container is according to the left hand rule if the conduit extends to the first side of the plane of rotation, and according to the right hand rule of the conduit extends to the second side of the plane of rotation. The frequency of the container rotation can be equal to the frequency of the container revolution.

The fluid can be supplied to the container through a first fluid conduit and removed from the container through a second fluid conduit. The position of conduit openings in the container can be changed. A characteristic of the fluid in the container can be sensed and a signal can be generated. The signal can be processed and the position of the conduit openings in the container can be changed responsive to the signal.

A method of centrifuging a fluid can include the steps of positioning the fluid in a container and rotating the container while revolving the container. The direction of a tangent to the rotation of the container can be opposite to the direction of a tangent to the revolution of the container. The frequency of rotation of the container can be equal to the frequency of revolution of the container.

BRIEF DESCRIPTION OF THE DRAWINGS

There are shown in the drawings embodiments that are presently preferred it being understood that the invention is not limited to the arrangements and instrumentalities shown, wherein.

DETAILED DESCRIPTION OF THE INVENTION

Figure 1:
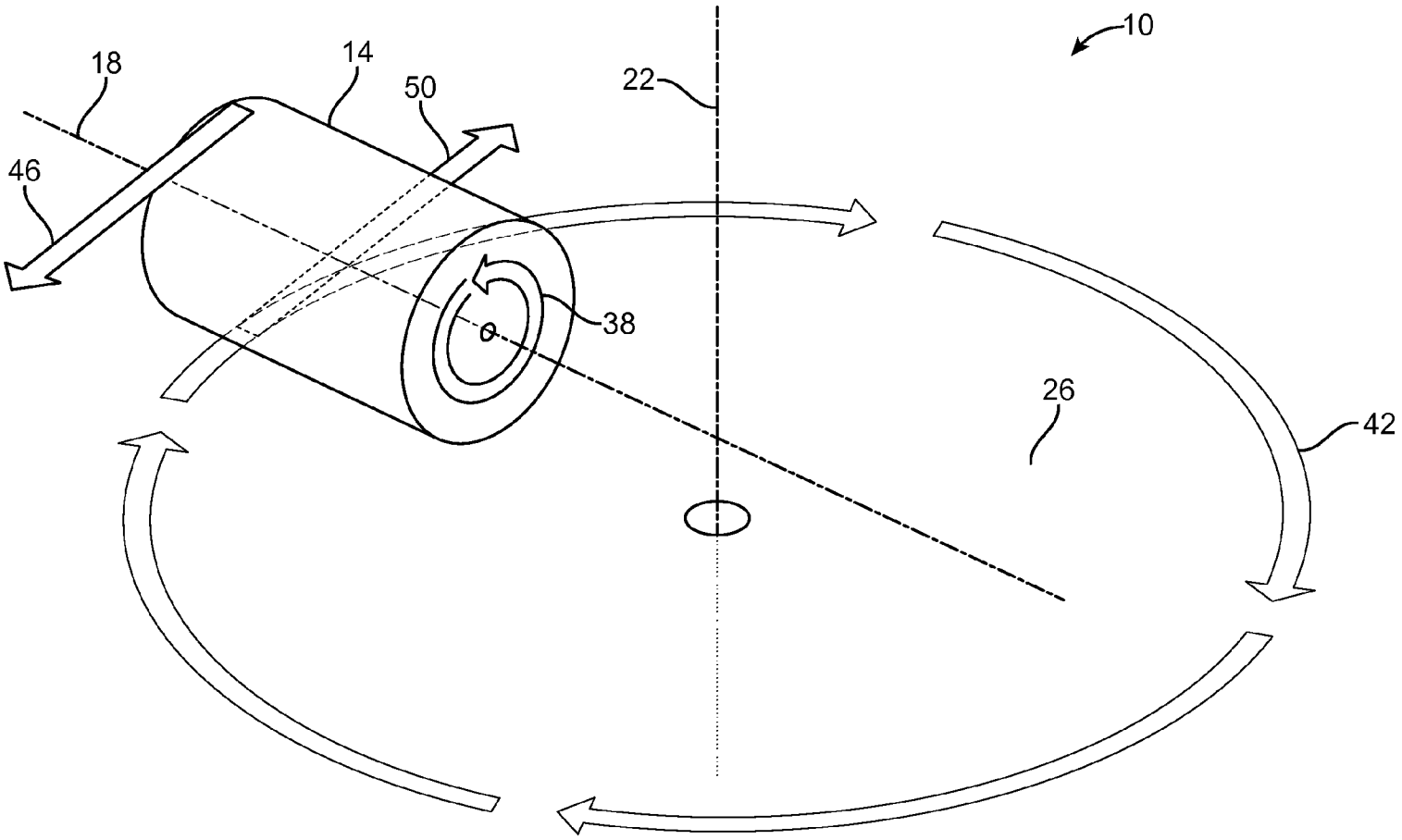
FIG. 1 is a schematic perspective of a centrifuge according to the invention.
Figure 2:
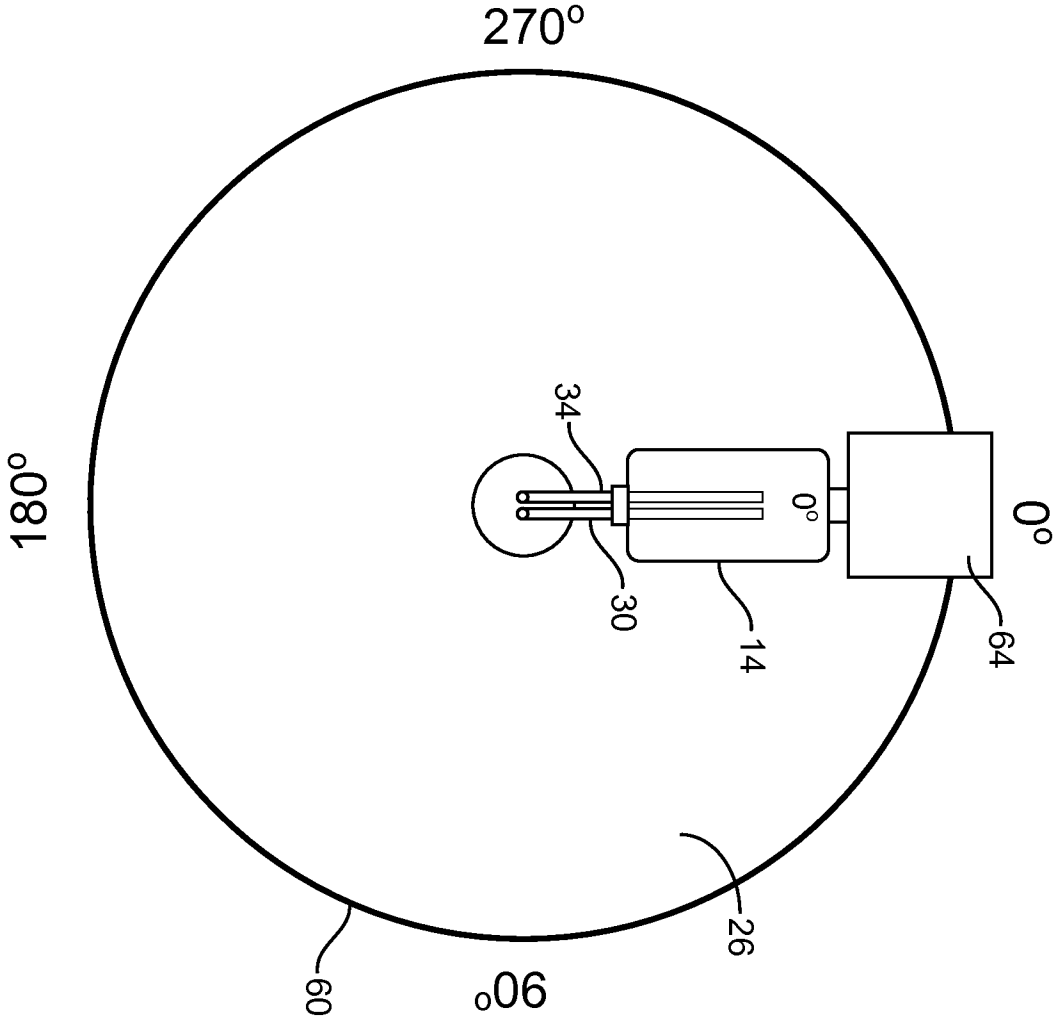
FIG. 2 is a schematic plan view.
Figure 3:
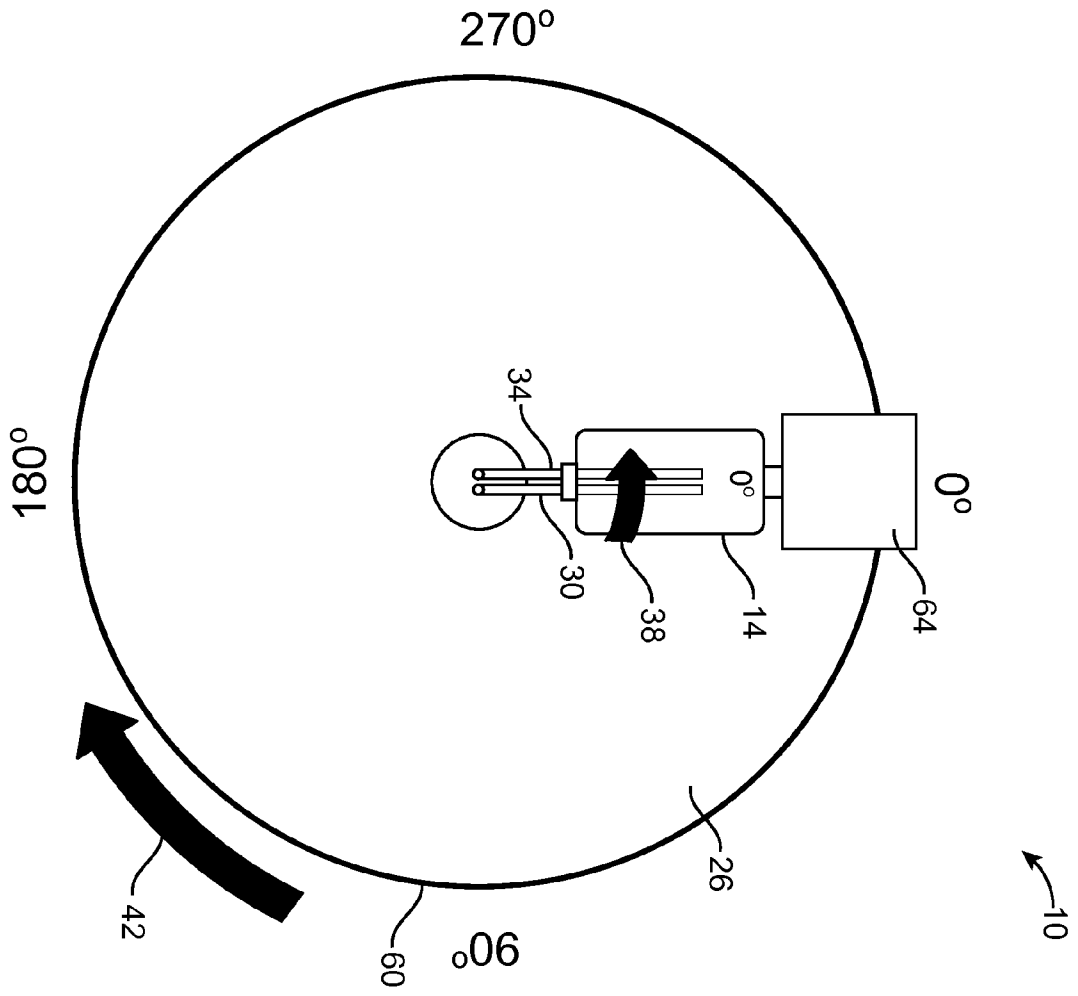
FIG. 3 is a schematic plan view in a first stage of operation.
Figure 4:
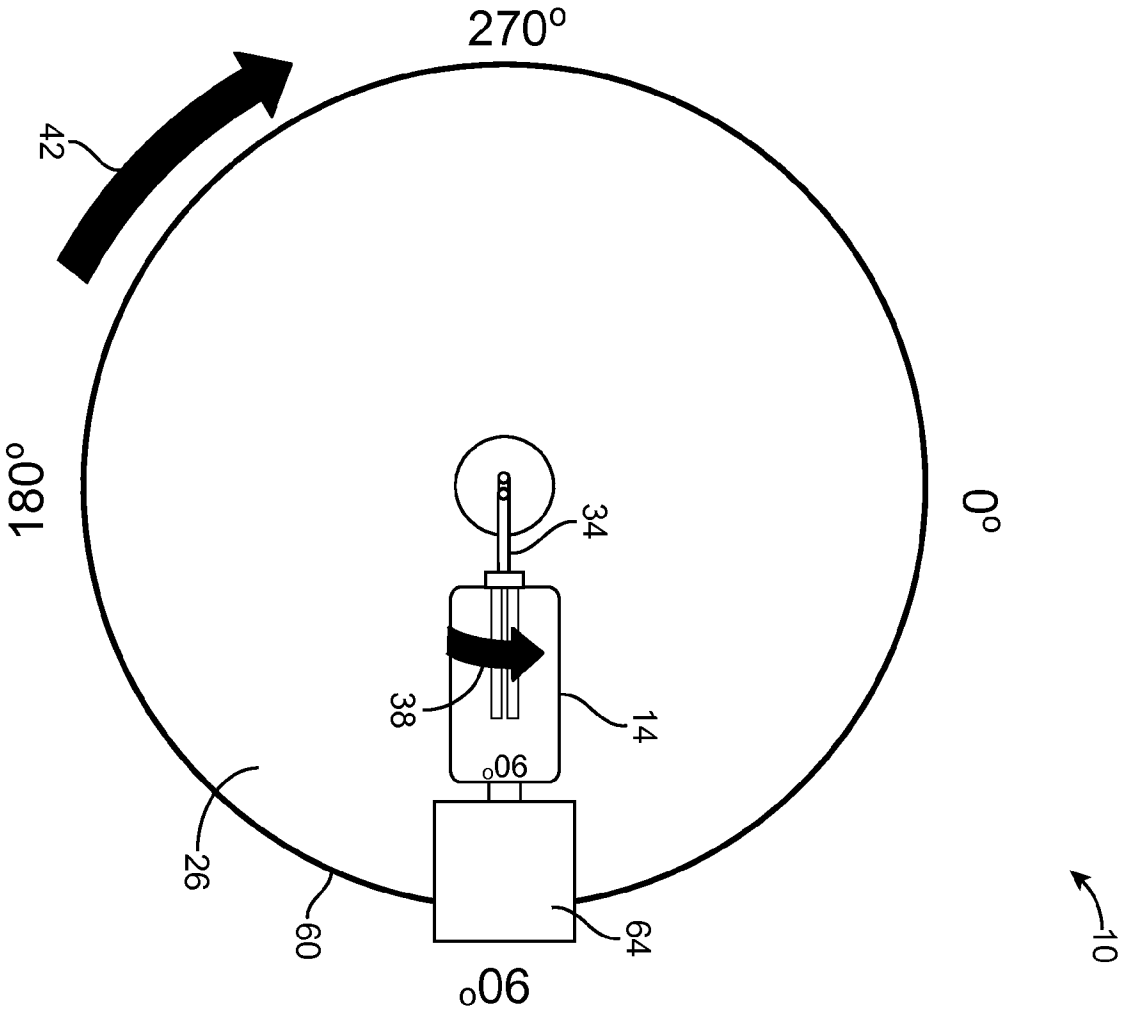
FIG. 4 is a schematic plan view in a second stage of operation.
Figure 5:
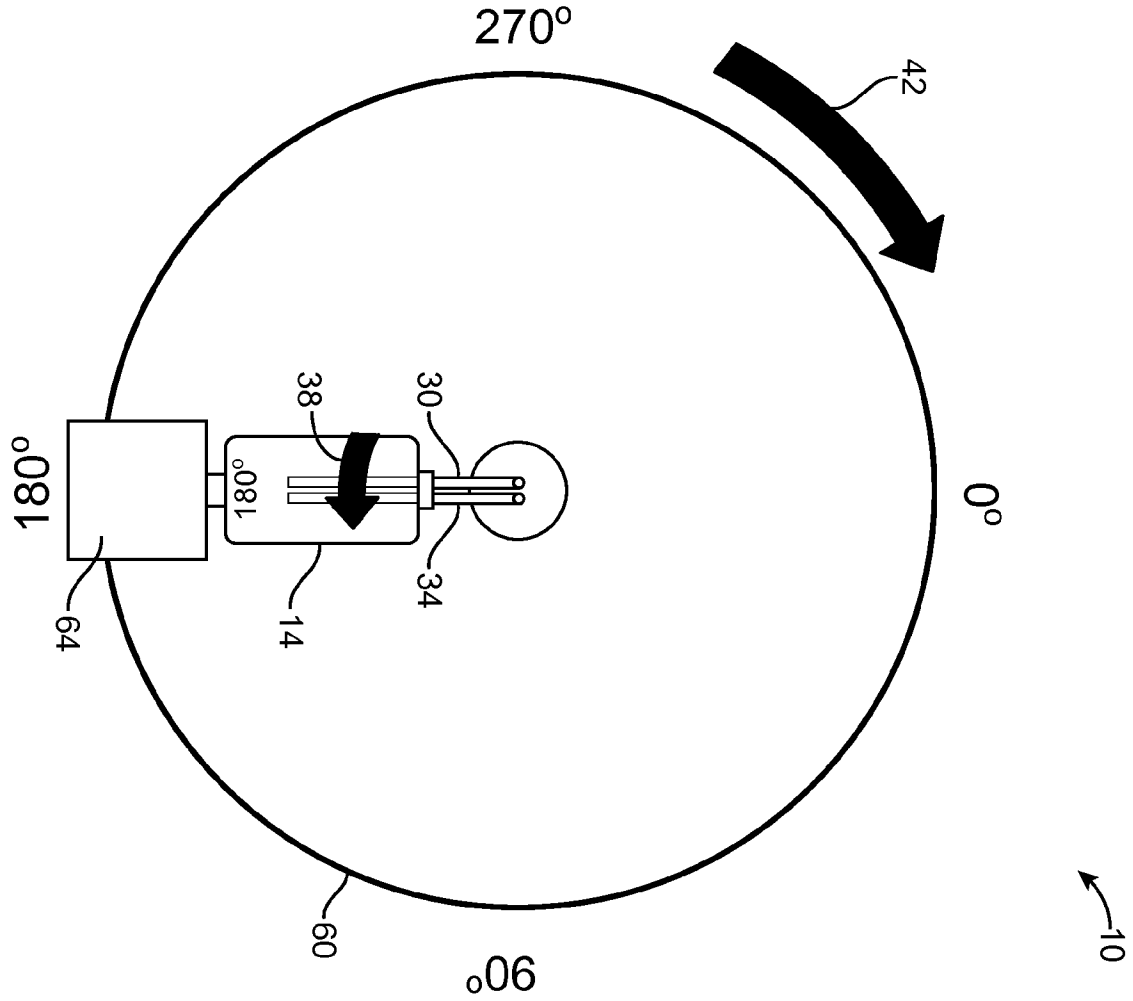
FIG. 5 is a schematic plan view in a third stage of operation.
Figure 6:
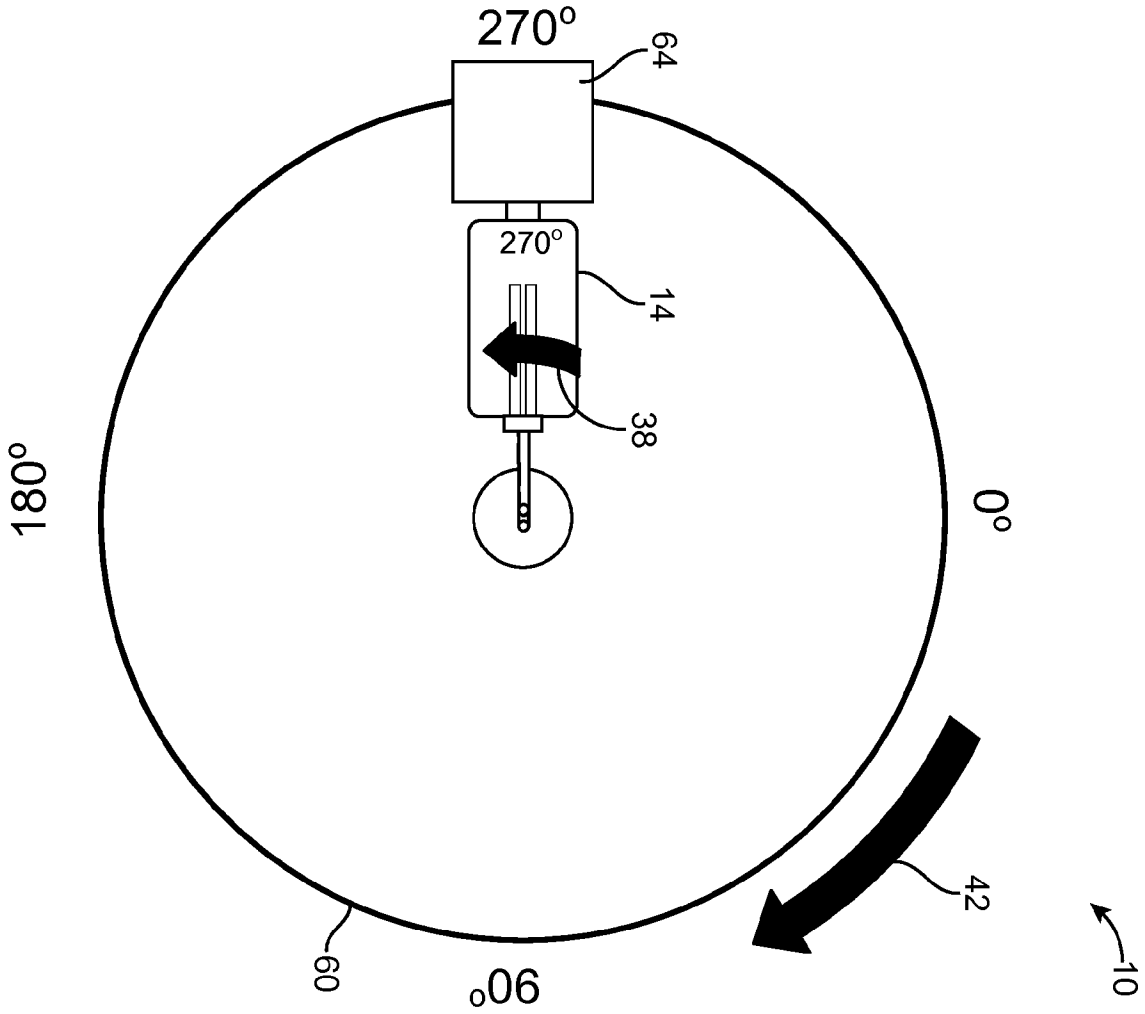
FIG. 6 is a schematic plan view in a fourth stage of operation.
Figure 7:
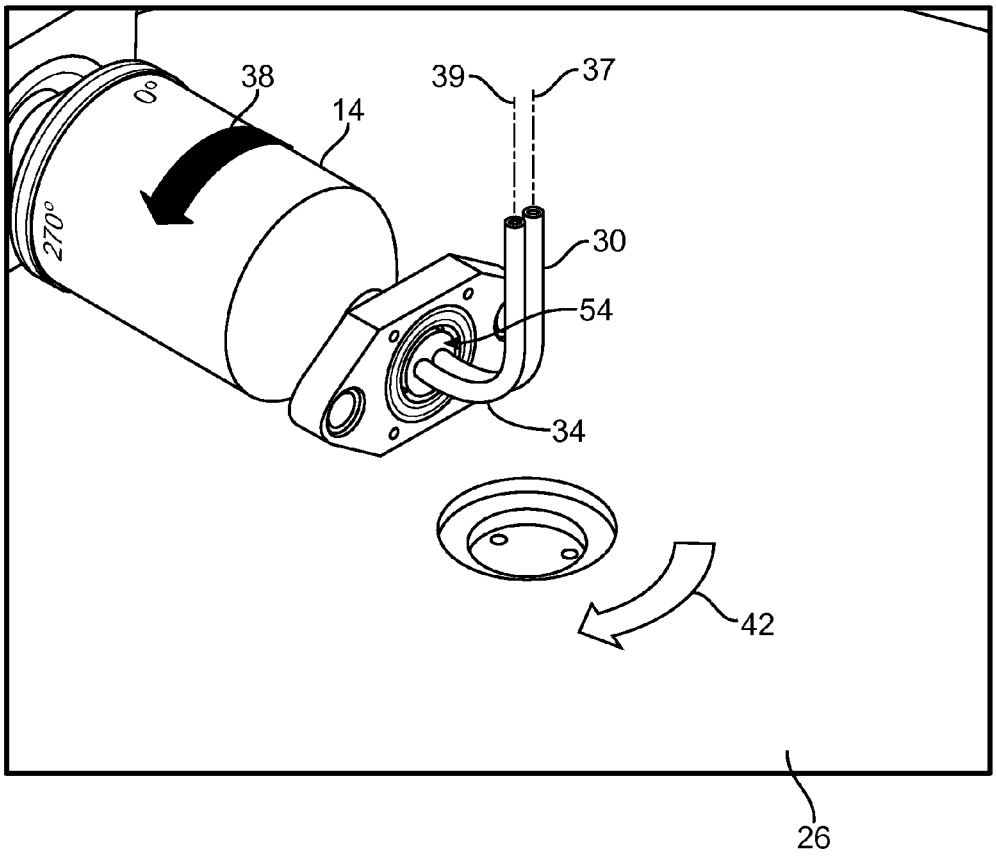
FIG. 7 is a perspective schematic view in a first stage of operation.
Figure 8:
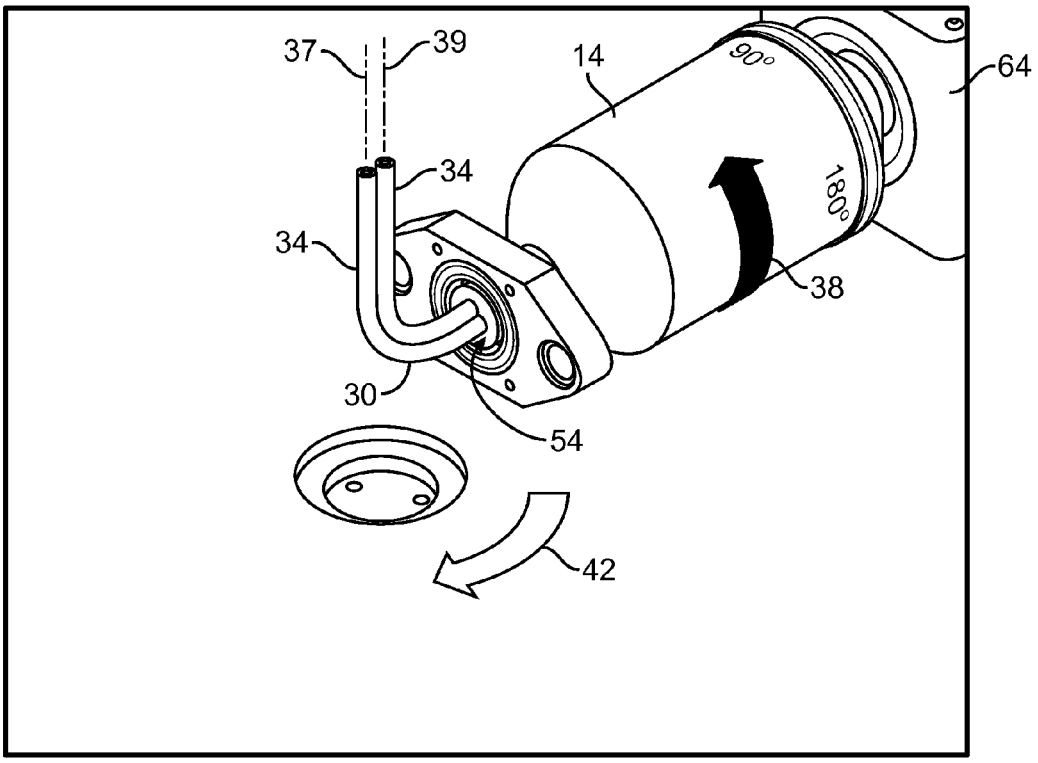
FIG. 8 is a perspective schematic view in a second stage of operation.
Figure 9:
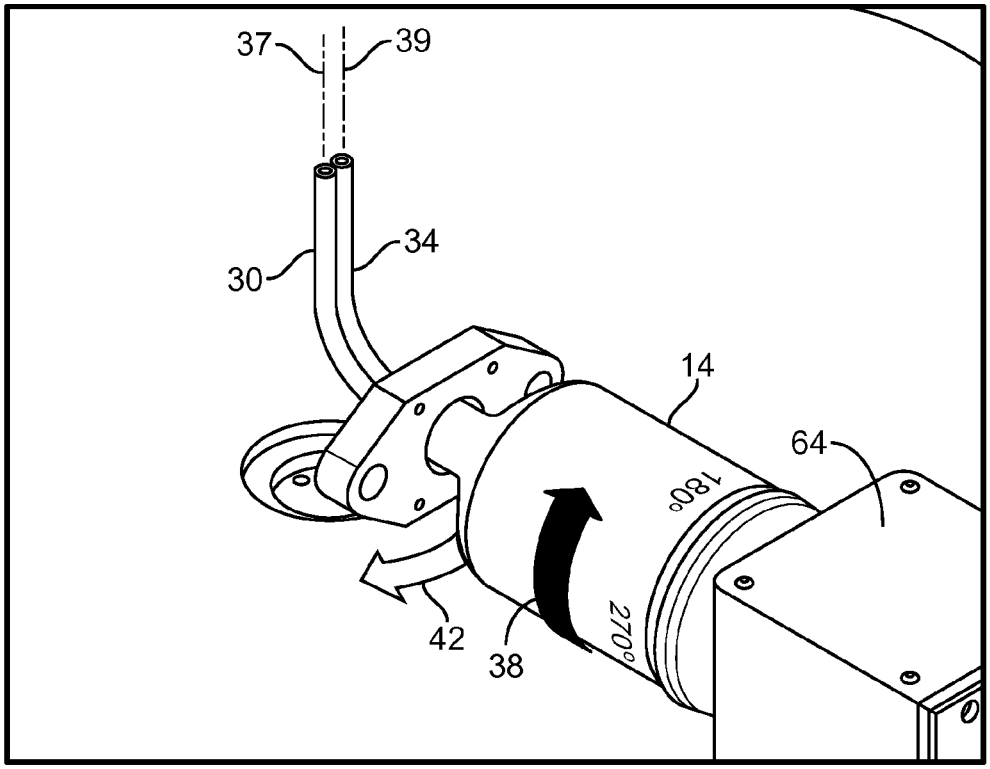
FIG. 9 is a perspective schematic in a third stage of operation.
Figure 10:
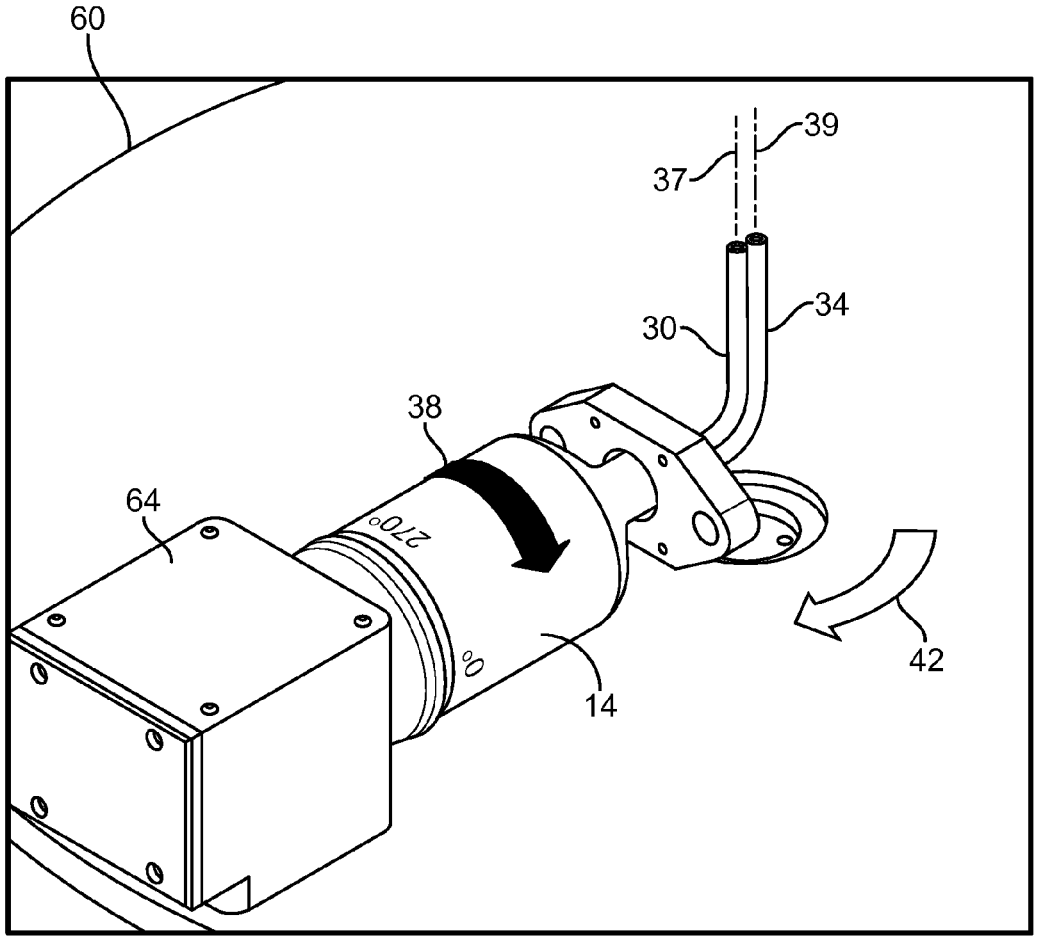
FIG. 10 is a schematic perspective of a fourth stage of operation.
Figure 11:
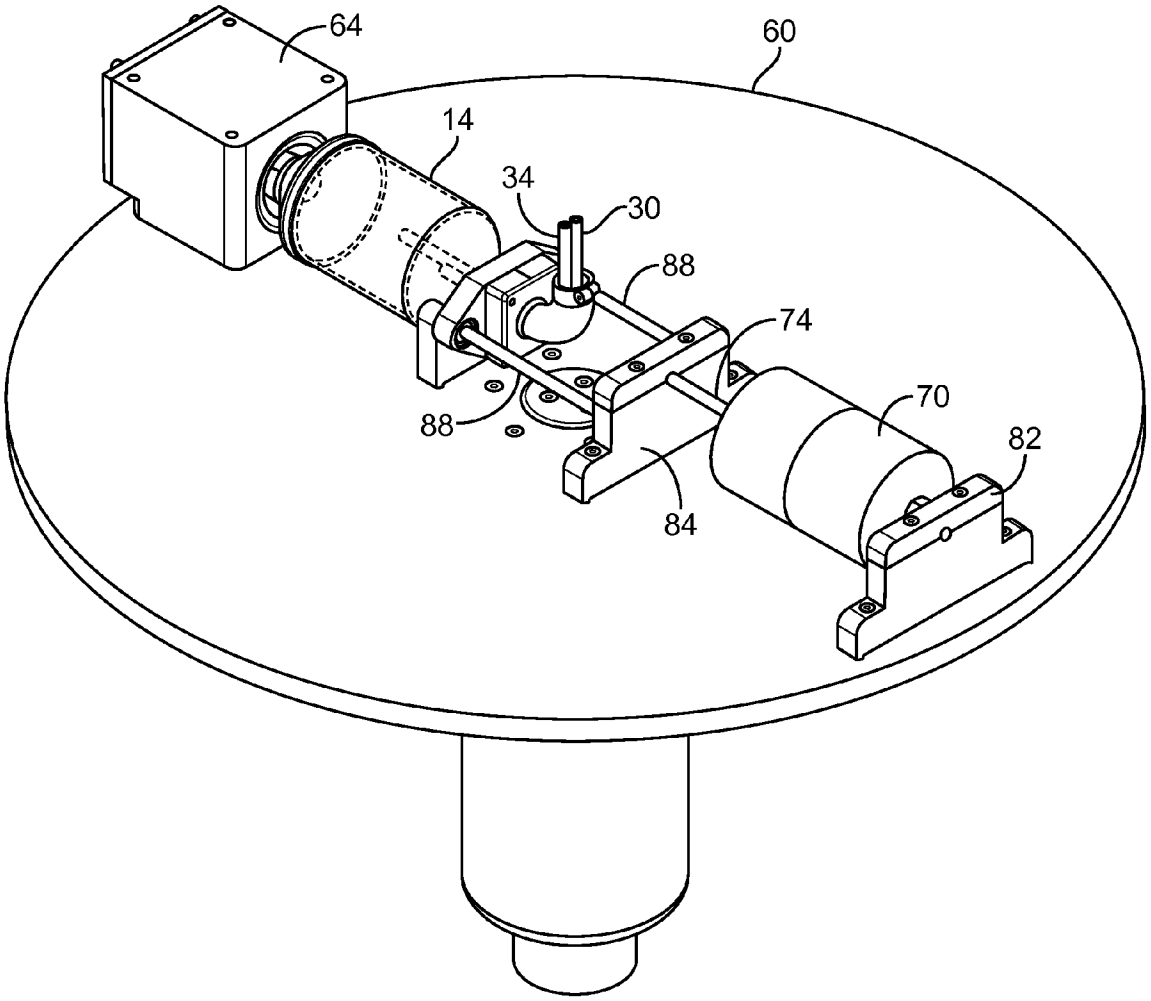
FIG. 11 is a perspective view, partially in phantom, of a centrifuge according to the invention.
Figure 12:
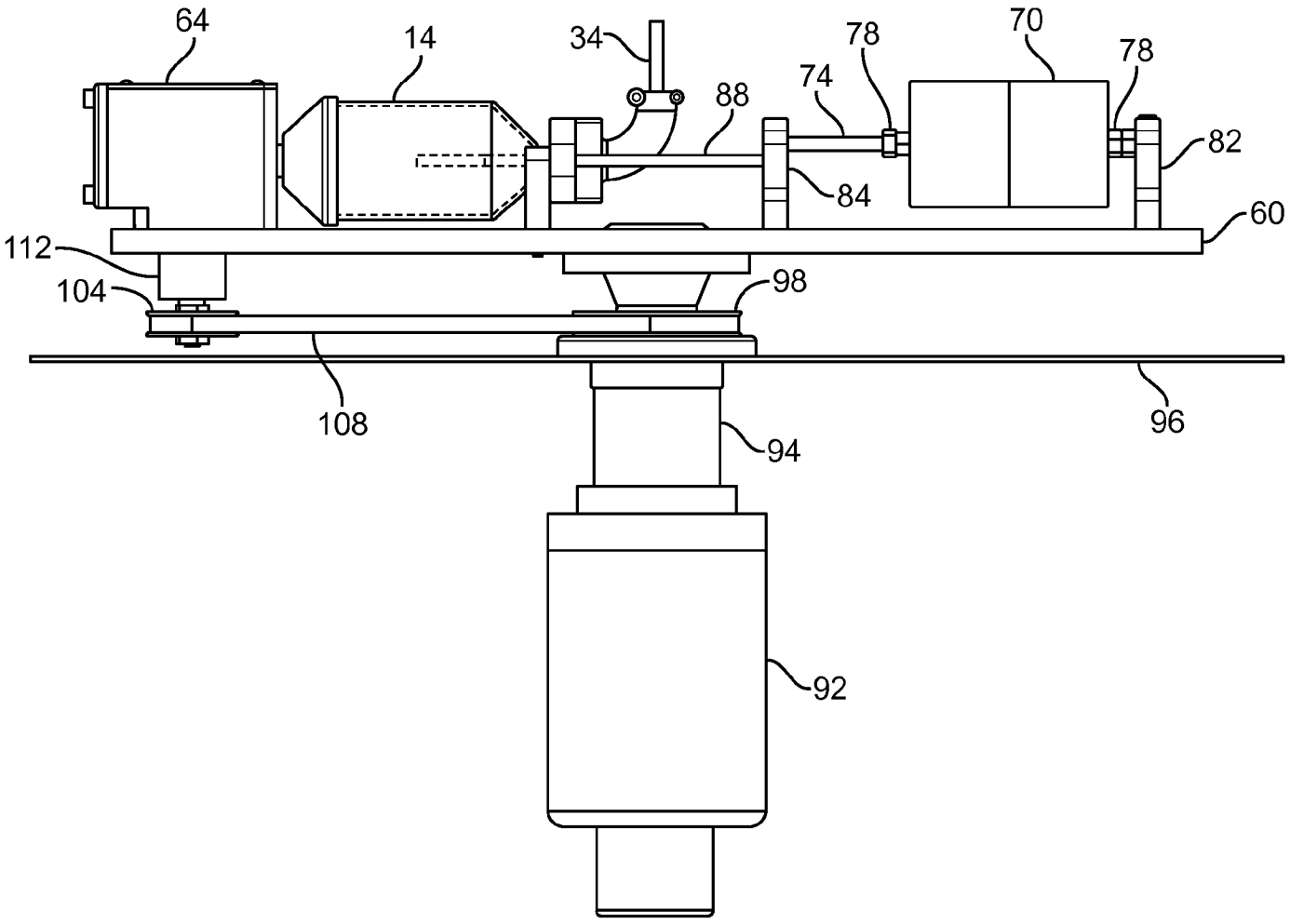
FIG. 12 is a side elevation, partially in phantom.
Figure 13:
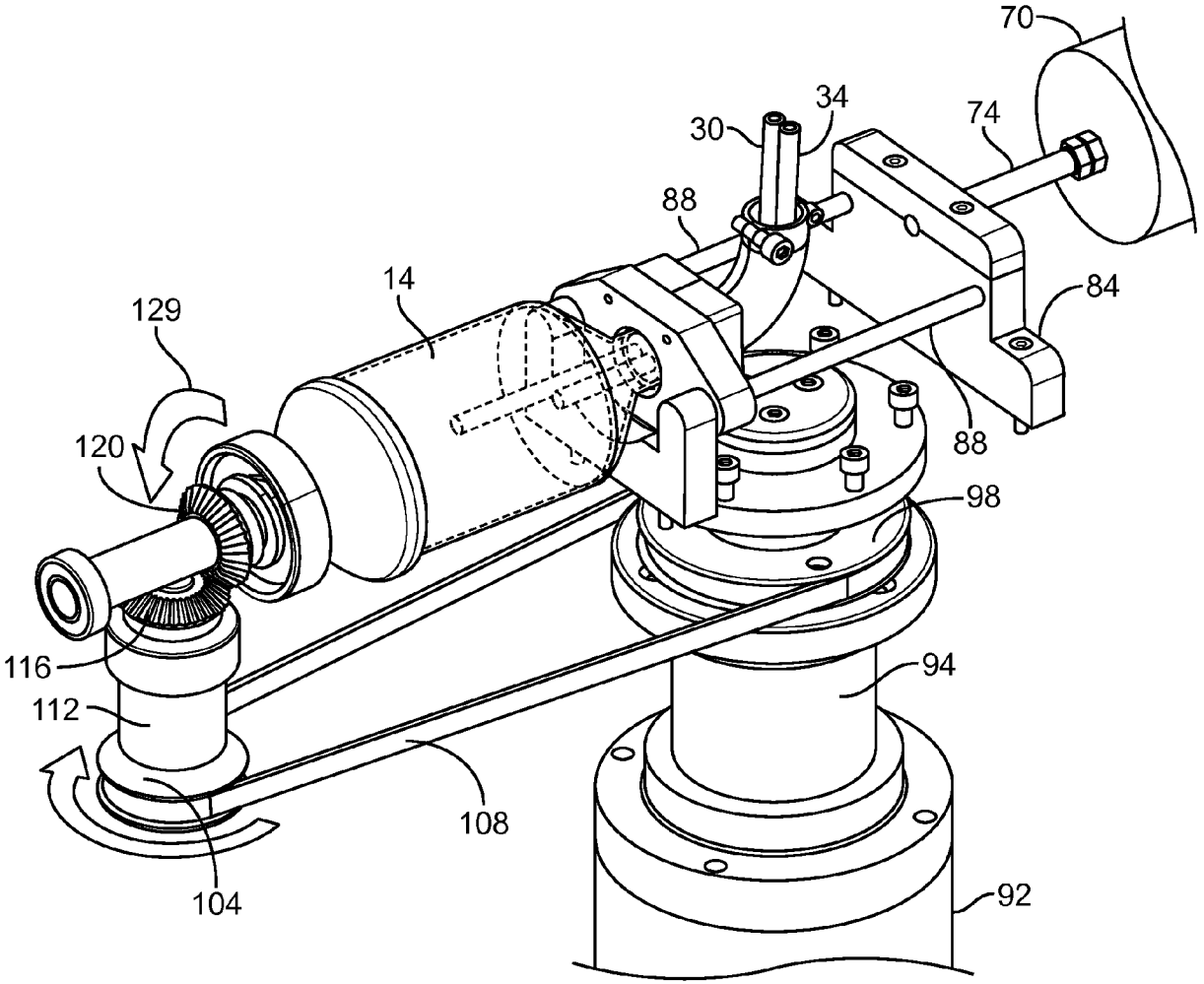
FIG. 13 is a perspective view, partially in phantom, and with a housing removed to reveal internal features.
Figure 14:
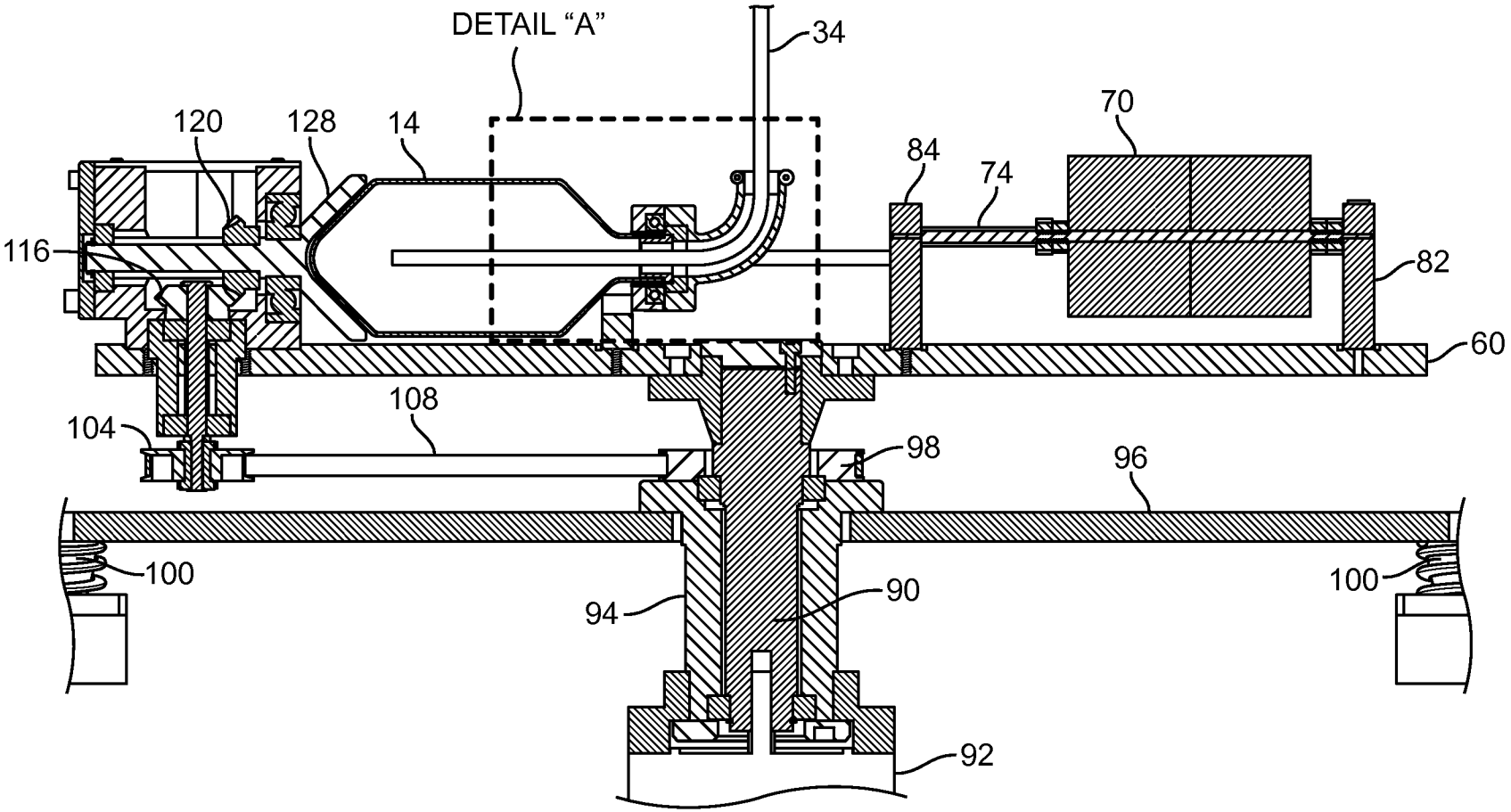
FIG. 14 is a cross-section.

As shown in FIGS. 1-10, a centrifuge 10 includes a container 14 and at least one drive for rotating the container 14 about its own axis 18 and revolving the container about an axis of revolution 22 and through a plane of revolution 26. At least one conduit 30 extends from the container to a first or second side of the plane of revolution. The axis of revolution can be perpendicular to the plane of revolution. The direction of rotation of the container can be according to the left hand rule if the conduit extends to the first side of the plane of rotation, and can be according to the right hand rule if the conduit extends to the second side of the plane of rotation. The frequency of the container rotation is equal to the frequency of the container revolution. One container 14 is shown, however, multiple containers can be provided in the same centrifuge and revolved and rotated simultaneously.

The centrifuge can further include a second fluid conduit 34 extending into the container 14. Any number of conduits can extend into the container 14. The first fluid conduit 30 can introduce fluid into the container 14, and the second fluid conduit 34 can remove fluid from the container. The first fluid conduit 30 and the second fluid conduit 34 have proximal ends 37, 39 that are fixed in space relative to the rotation and revolution of the container. The position of the first conduit 30 and/or the second conduit 34 within the container 30 can be adjusted manually by sliding the conduit in or out as desired, or an appropriate actuator can be provided to adjust the position as desired. Also, any spatial orientation of the container 14 and the conduits 30, 34 is possible such as, without limitation, a complete inversion of the orientations that are shown.

The centrifuge 10 can also include a bearing seal 54. The first fluid conduit 30 and second fluid conduit 34 can be connected to the bearing seal assembly 54. The bearing seal assembly 54 can be rotatably mounted to the container 14. The bearing seal assembly 54 permits the conduits 30, 34 to remain relatively stationary as the container 14 rotates. Various container seal constructions are possible which will seal the junction of the conduits 30, 34 with the container 14, while permitting the container 14 to rotate independently of the conduits 30, 34.

The centrifuge 10 can also include a container support 60. The container can be rotatably mounted to the container support. The container support 60 can be a disk or plate, or any other suitable construction, and the plane of revolution 26 can be defined by the plate 60.

The container 14 rotates according to the arrow 38 about its own axis 18 as it revolves according to the arrow 42 about an axis of revolution 22. The direction of rotation is substantially opposite to the direction of revolution of the container 14. A tangent 46 to the rotation of the container at a point farthest from the plane of revolution 26 is substantially oppositely directed to a tangent 50 to the revolution 42 at the same point of the revolution. The frequency of rotation is substantially the same as the frequency of revolution. Conduits 30, 34 enter the container 14 and extend only on a first side of the plane 26 of revolution, and are unwound at the same rate that the revolution 42 of the container 14 would otherwise wind and twist such conduits. The container 14 revolves about its axis of revolution in a clockwise direction and, when viewed from the axis of revolution, the container 14 rotates about its own axis in a counterclockwise direction. This is shown in FIGS. 3-10, where at 0°, 90°, 180°, and 270° of revolution 42 of container 14, there is corresponding 0°, 90°, 180°, and 270° rotation 38 of container 14.

Suitable structure 64 can be provided to rotate the container 14. The structure 64 can be any suitable structure. In one embodiment the structure 64 is a motor or electric drive that is directly connected to the container 14 to cause rotation of the container 14. In another embodiment, the drive is indirectly connected to the container 14 such as structure 64 having gears which are connected to a suitable motor or drive mechanism. Suitable structure is also provided to revolve the container 14 about the axis of revolution. This can be separate structure or mechanically connected structure. An example of suitable structure for rotating and revolving the container 14 is illustrated in FIGS. 11-15. The manner in which the container 14 is rotated and revolved can vary. There is shown in FIGS. 11-15 an embodiment which utilizes a drive motor, and a series of pulleys, gears and the timing belt to effect the coordinated rotation and revolution of the container 14, although other drive structure is possible. A motor 92 rotates inner shaft 90 which is secured within a bottom shaft spacer 94. The inner shaft 90 can extend through a surface 96. Compression springs 100 can support the surface 96 to reduce vibration. The inner shaft 90 is secured to the support disk 60, and rotation of the inner shaft 90 thereby rotates the container support disk 60. Rotating pulley 98 is rotated once with every rotation of the inner shaft 90. The rotating pulley 98 is connected to an outer pulley 104 by a timing belt 108. Rotation of the rotating pulley 98 causes the timing belt 108 to rotate the outer pulley 104. The outer pulley 104 is connected by a shaft 112 to a lower bevel gear 116. Rotation of the lower bevel gear 116 causes rotation of an upper bevel gear 120 which is in contact with the lower bevel gear 116. Rotation of the upper bevel gear 120 causes rotation of the container holder 128 and thereby the container 14 as indicated by arrow 129. The connection between the bevel gears rotates the container 14 on a 1:1 ratio with respect to the centrifuge. The ratio between two pulleys does not affect the rotation of the outer pulley. One complete revolution of the support 60 is equal to one revolution of the outer pulley 104 which in turn causes rotation of the container 14 once. The length of the timing belt 108 does not affect the fact that the outer pulley 104 rotates on a 1:1 ratio with the support disk 60.

The centrifuge can have suitable structure to balance the rotation of the centrifuge and prevent unnecessary vibration, such as a counterweight 70 positioned opposite to the container 14 relative to the axis of revolution of the container 14. The position of the counterweight 70 can be adjustable. The counterweight 70 can be provided on a threaded support 74 and the position can be moved by adjustable threaded nuts 78. The threaded support 74 can be positioned between end supports 82, 84. Braces 88 can be provided to secure the assembly together. Alternative balancing structure is possible.

Figure 15:
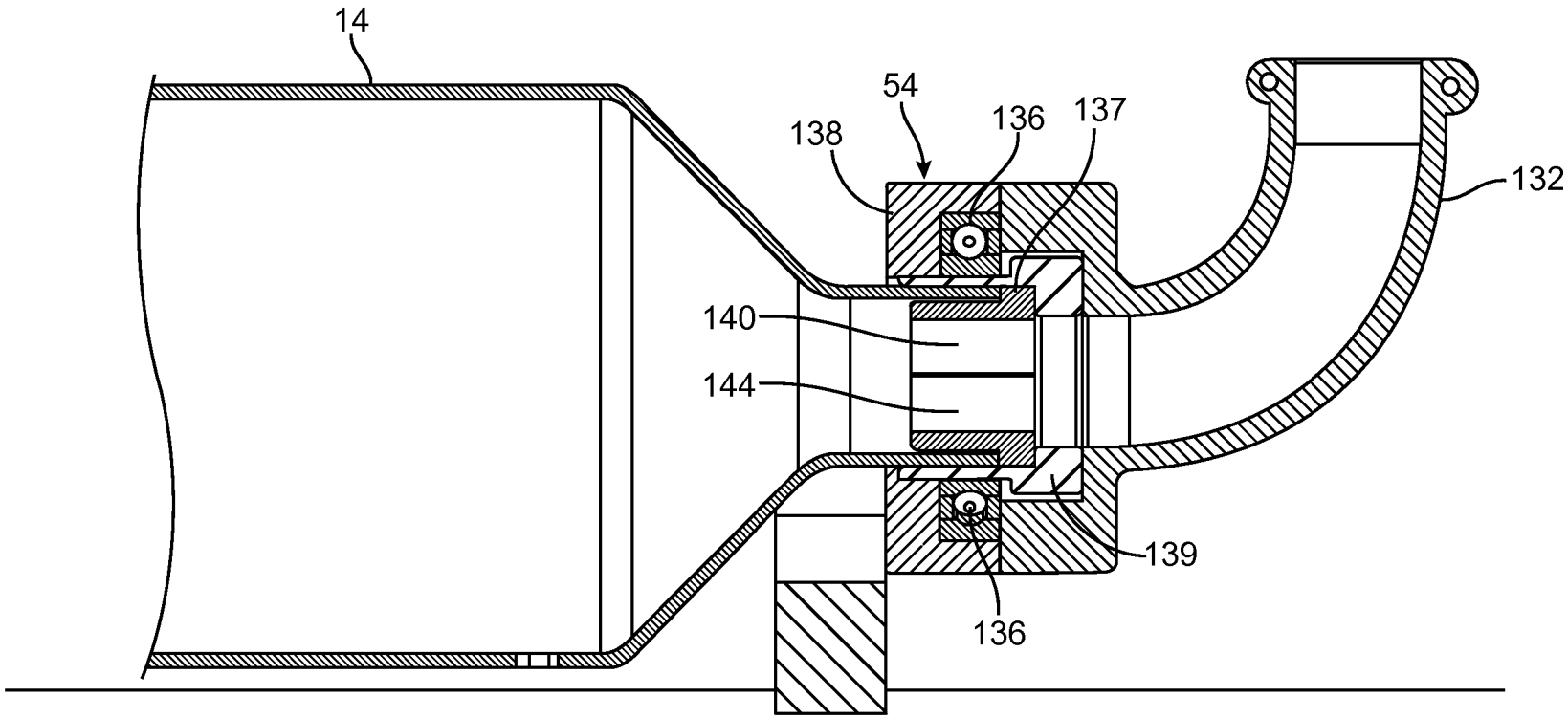
FIG. 15 is an enlarged view of Detail "A" in FIG. 14.

The conduits 30, 34 extending into the container 14 by suitable structure such as conduit guide 132 (FIG. 15). The bearing seal assembly 54 includes bearings 136 mounted in bearing housing 138, and thereby can rotate freely with respect to the container 14. Thereby, as the container 14 is rotated the bearing seal assembly 54 and conduits 30, 32 through passages 140, 144 in container seal 137 can rotate freely with respect to the container 14. The conduits are shown as a single continuous piece of tubing, however, ti it is possible that the conduits are segmented in various components and that the conduit extending to the container is joined to another conduit segment extending into the container. Various sizes, shapes and types of conduits are also possible, including coaxial or conjoined conduits. One or more conduits can extend into the container, or can open into the container without extending into the container. A bushing 139 can be interposed between the bearing 136 and the container 14 and container seal 137 of the bearing seal assembly 54.

Figure 18:
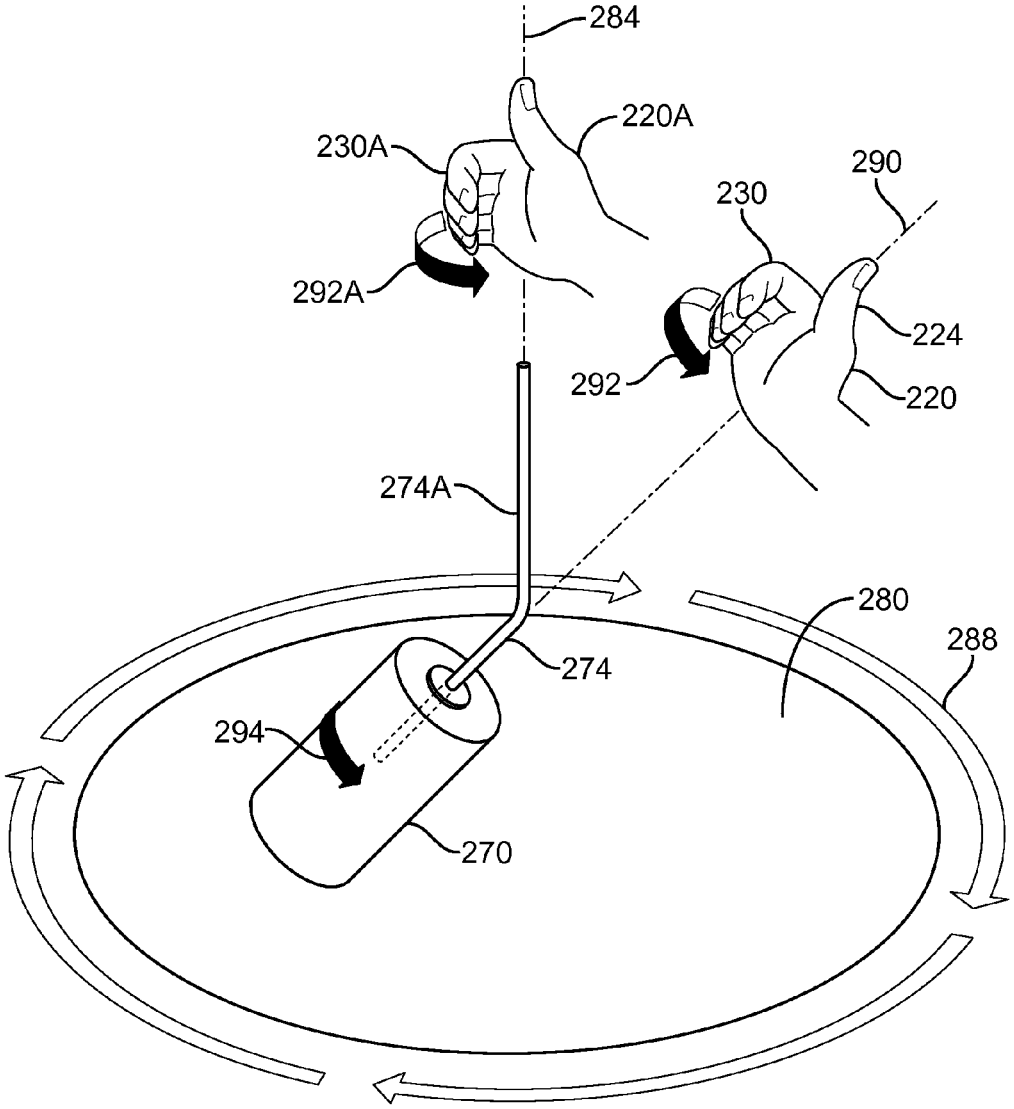
FIG. 18 is a schematic diagram of the right-hand rule as applied to an angled container embodiment.
Figure 19:
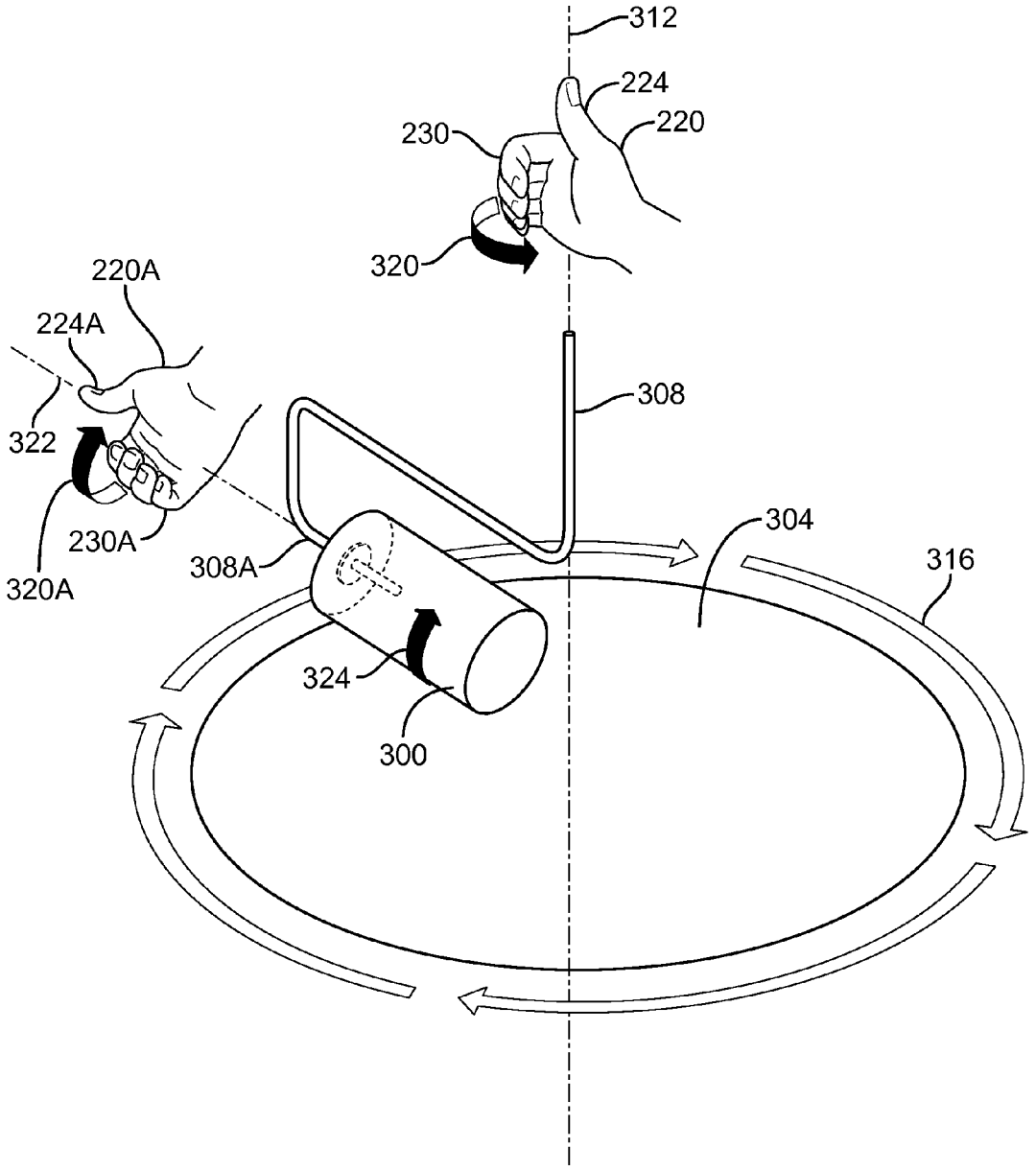
FIG. 19 is a schematic diagram of the right-hand rule according to an outwardly directed conduit embodiment.
Figure 20:
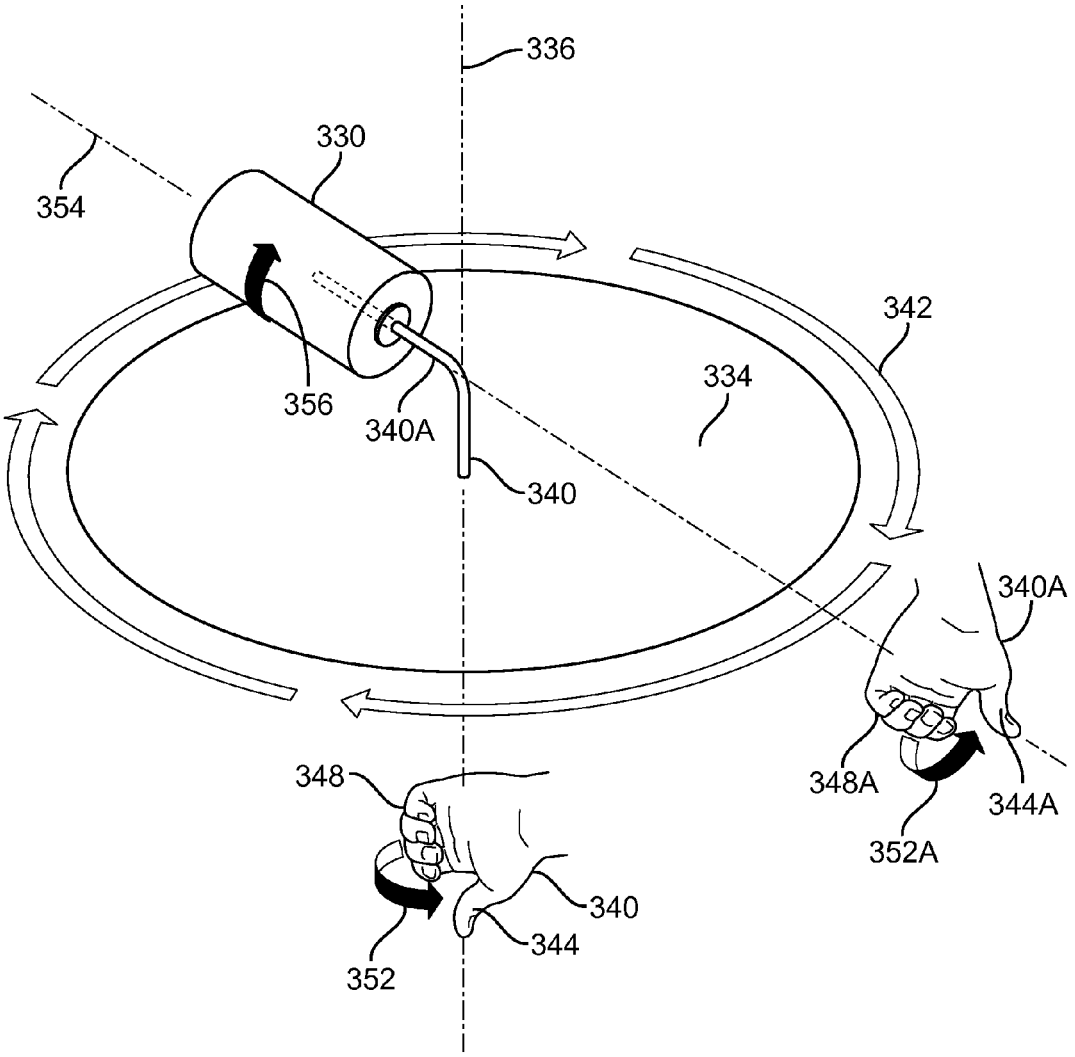
FIG. 20 is a schematic diagram of the left-hand rule as applied to a centrifuge according to the invention.
Figure 21:
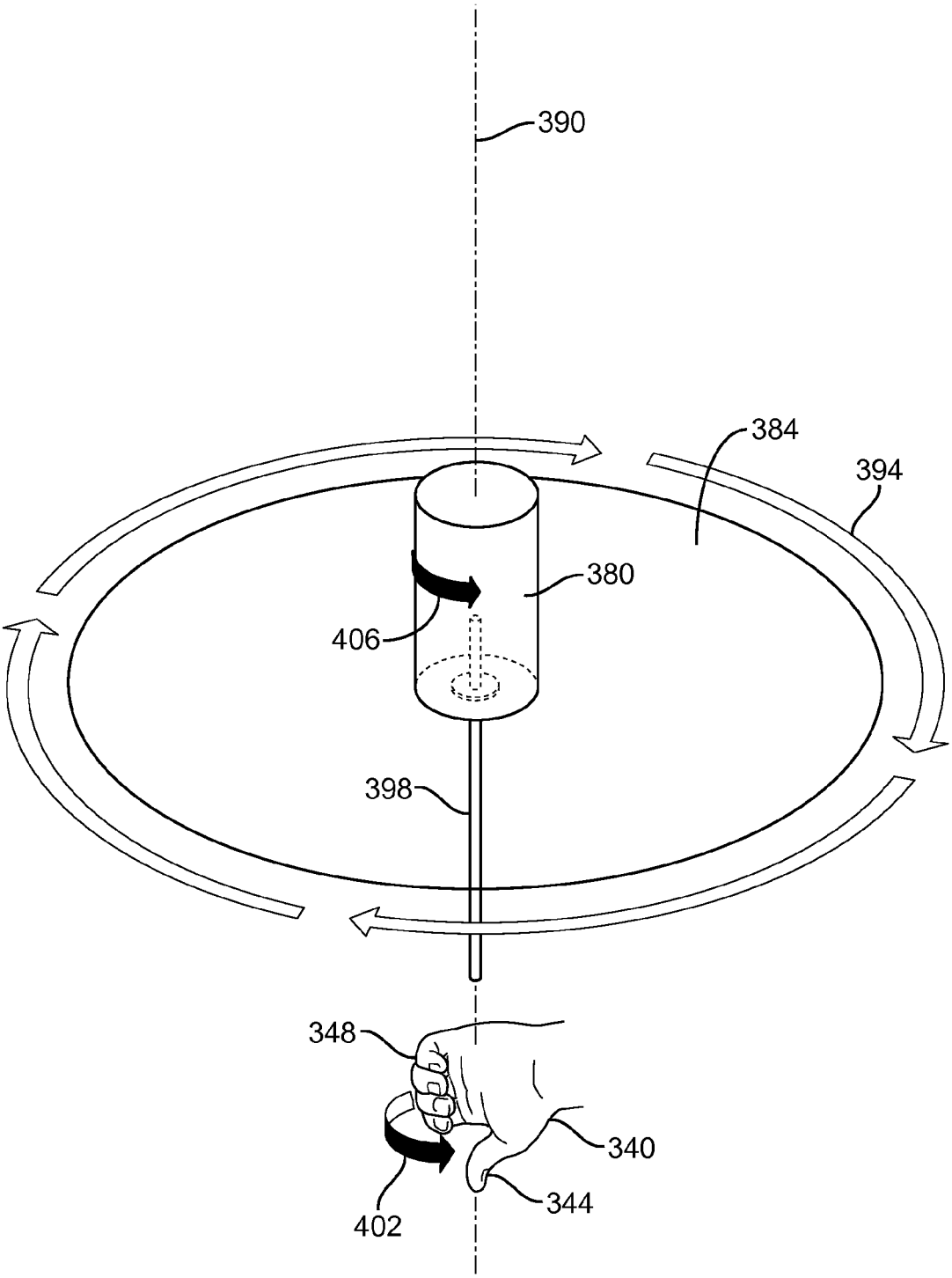
FIG. 21 is a schematic diagram of the left-hand rule according to a vertically oriented container embodiment.
Figure 22:
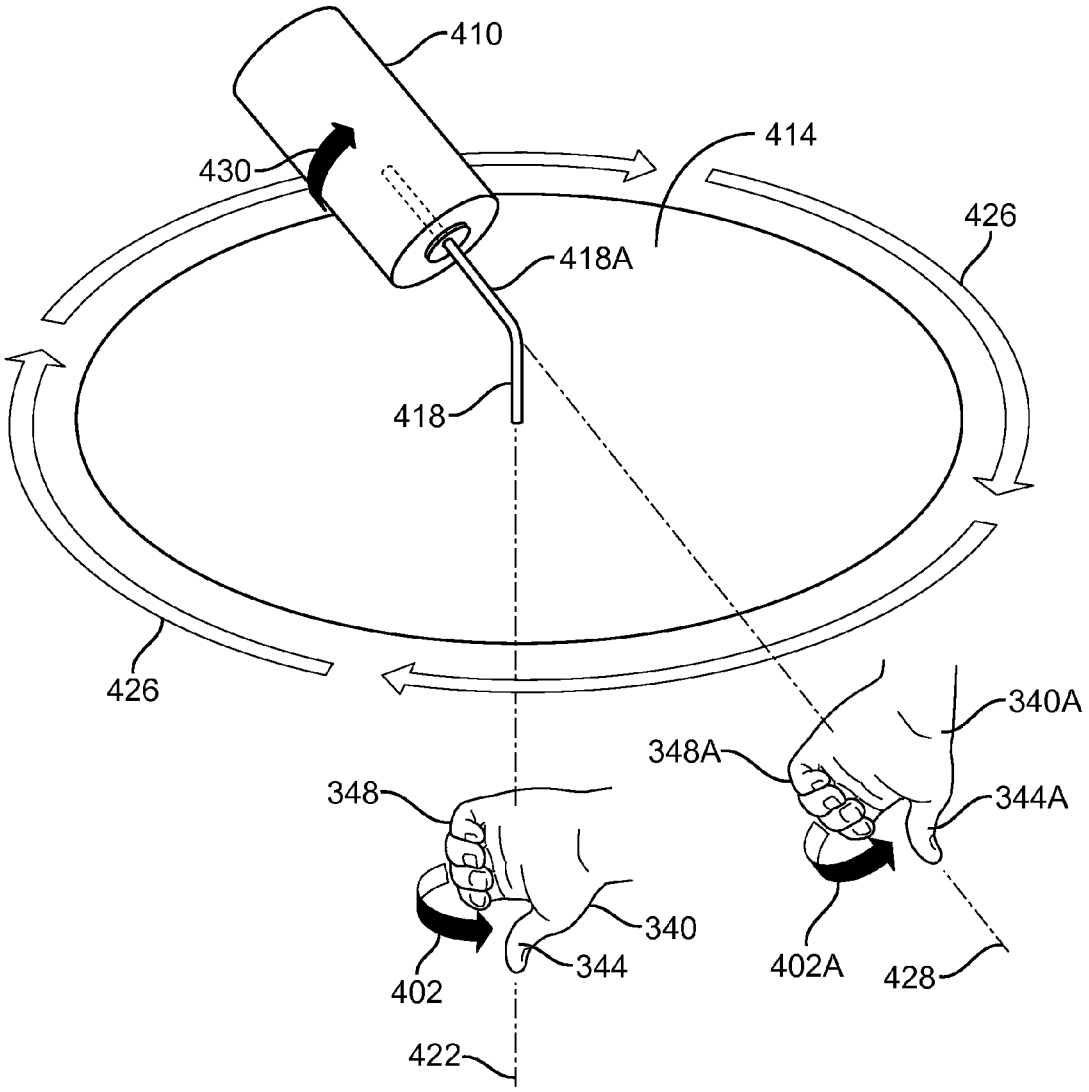
FIG. 22 is a schematic diagram of the left-hand rule as applied to an angled container embodiment.
Figure 23:
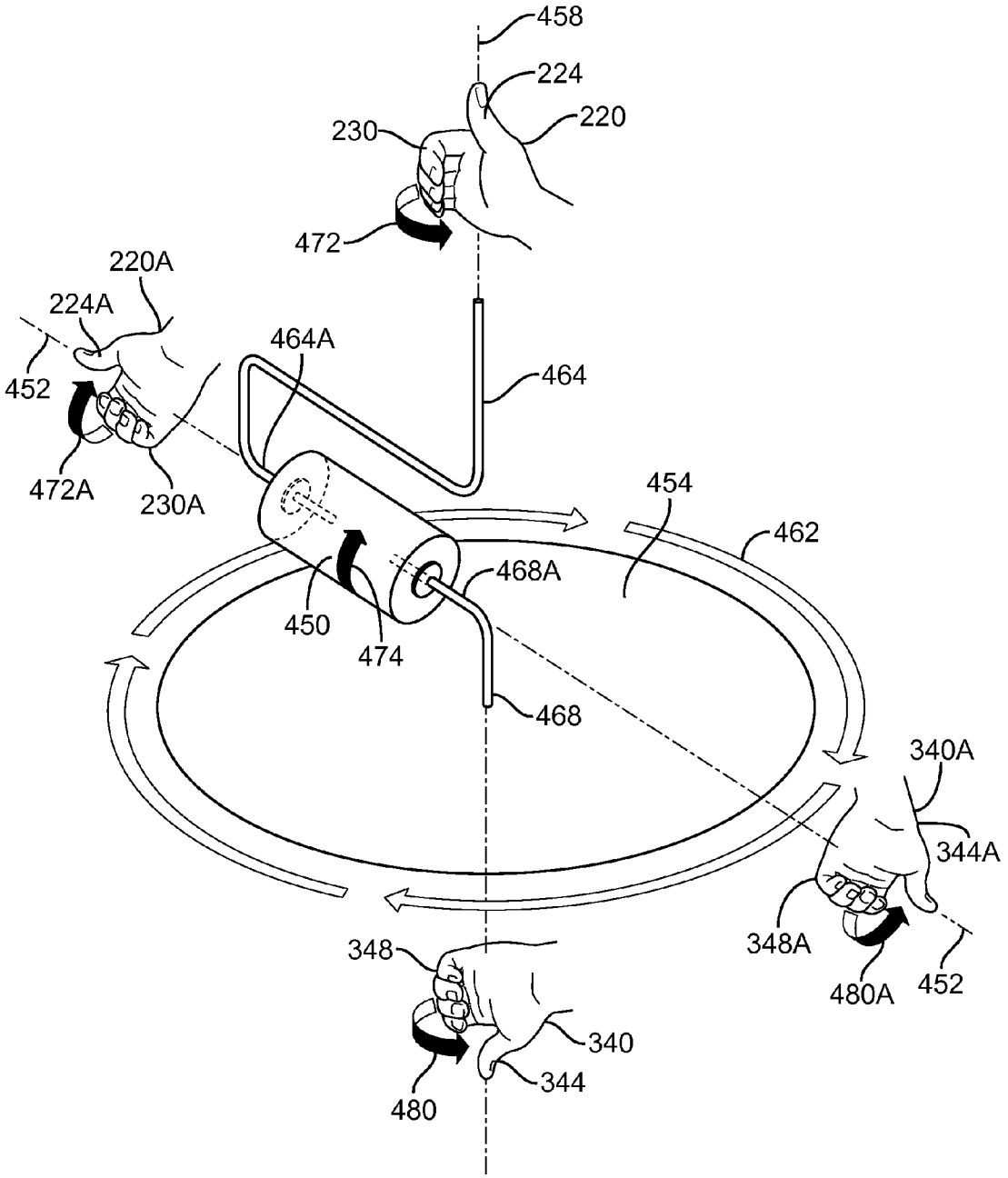
FIG. 23 is a schematic diagram of an embodiment with conduits extending on both sides of the plane of container revolution.

FIGS. 16-23 illustrate the direction of container rotation as it relates to container revolution and the position of the conduits leaving the container. It is possible to direct the conduits leaving the container to either side of the plane of revolution. The direction of rotation of the container must change depending on this orientation of the conduits leaving the container. The application of the left-hand or right-hand rule can be determined as follows. The thumb should be facing the direction in which the conduit is extending from the centrifuge support disk. The direction of rotation of the centrifuge support disk, and thereby of revolution of the container mounted to the disk, should be determined. The hand where the thumb points in the direction of the conduit and the curled fingers are in opposite direction to the revolution of the container disk is the appropriate hand for use in determining the direction of container rotation. The direction of finger curling is the direction of rotation of the container. Thus in FIG. 18 the right-hand 220 is shown in an orientation where the fingers 230 curl in a direction indicated by arrow 292 that is opposite the direction of rotation of the centrifuge support disk 280 as indicated by arrows 288. The right-hand rule should be applied. In FIG. 20 it can be seen that the left-hand 340 is oriented with the thumb 344 in the direction in which the conduit 340 is directed. The fingers 348 curl in the direction shown by arrow 352 and which is opposite to the direction of the arrows 342 indicating the direction of rotation of the centrifuge support disk 334. It can be seen that the right-hand could not meet these criteria. The left-hand rule should be applied. Similarly the application of this test in FIG. 22 with the left-hand 340 indicates that the left-hand rule satisfies this test as indicated by arrow 402 opposite to the direction of rotation of the centrifuge support disk 414 as indicated by arrows 426. In FIG. 23 the left-hand rule satisfies this condition with respect to the conduit 468 as indicated by the left-hand 340 and arrow 480 while the right-hand rule is satisfied with respect to the conduit 464 as indicated by the right-hand 220 and arrow 472.

Figure 16:
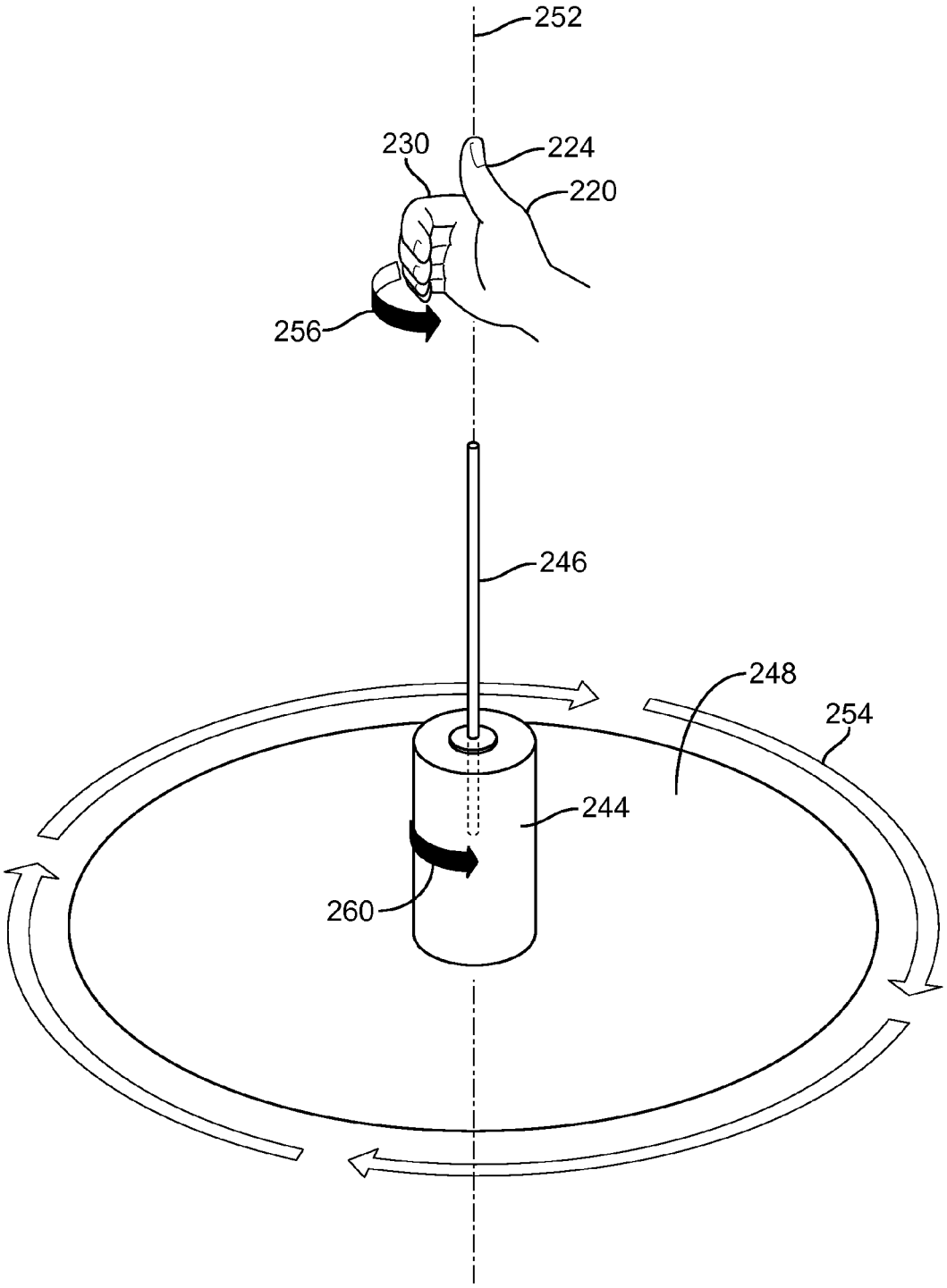
FIG. 16 is a schematic diagram of the right-hand rule as applied to a vertically oriented container embodiment.

There is shown in FIG. 16 a container 244 mounted orthogonally to the centrifuge support plate or disk 248. A conduit 246 exits the container 244. The disc 248 rotates about an axis 252 as indicated by arrow 254. Right hand 220 is oriented with the thumb 224 pointing in the direction in which the conduit 246 leaves the container 244. The fingers 230 curl in the direction indicated by the arrow 256 which defines the necessary direction of rotation of the container 244 as indicated by arrow 260.

Figure 17:
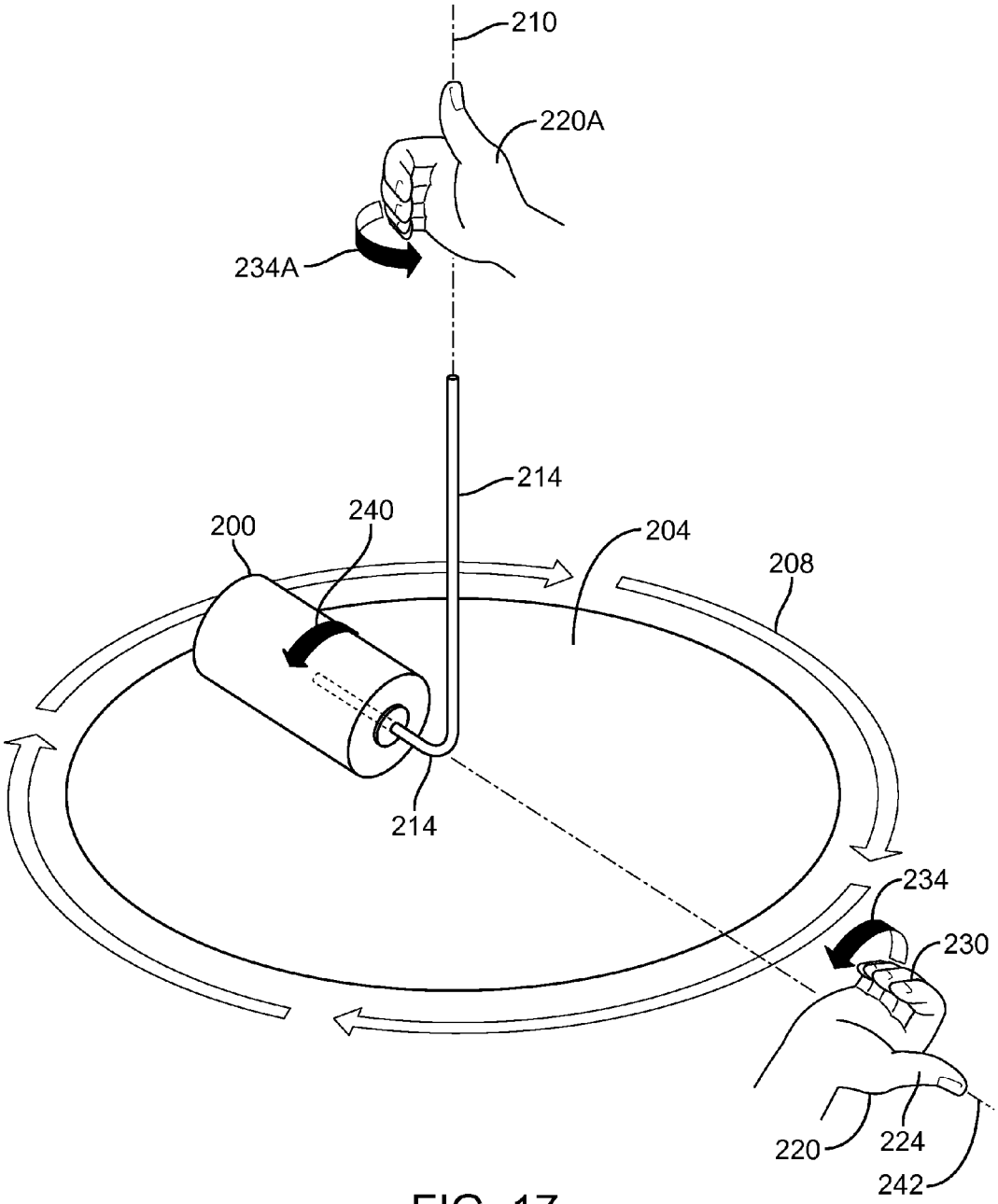
FIG. 17 is a schematic diagram of the right-hand rule as applied to a centrifuge according to the invention.

This concept is illustrated again in FIG. 17, where container 200 is horizontally oriented and provided on a centrifuge support disk or plate 204 such that rotation indicated by arrow 208 of the disk 204 causes the container 200 to revolve around the axis of rotation 210 of the disk 204, which is also the axis of revolution of the container 200. A conduit 214 exits the container 200 on a first side of the disk 204 defining the plane of revolution. This is the top side of the disc 204 in FIG. 16 however it will be apparent that the disk 204 could be oriented otherwise in space such that one side might be the left side and the other the right side, rather than top and bottom as shown. The direction of rotation of the container 200 about its own axis is determined by the right hand rule. The hand 220 is oriented with the thumb 224 pointed in the direction at which the conduit 214 exits the container 200. The fingers 230 are curled and this direction indicated by arrows 234 defines the direction of rotation of the container 200 indicated by arrow 240 about axis 242 necessary to prevent tangling of the conduit or conduits 214. The right hand rule also applies to a portion of the conduit 214A extending vertically as indicated by a second position of the right hand 220A and arrow 234A.

A container 270 can be oriented at an angle between 0° and 90° such as 45° shown in FIG. 18. A conduit 274 extends from the container 270. A centrifuge support disk 280 rotates about an axis 284 as indicated by the arrows 288. The right-hand 220 is oriented with the thumb 224 in the direction in which the conduit 274 leaves the container 270. The fingers 230 curl in the direction of arrow 292 and indicate the appropriate direction of rotation of the container 270 about axis 290 as indicated by arrow 294. The right hand rule also applies to a portion of the conduit 274A extending vertically as indicated by a second position of the right hand 220A and arrow 292A.

There is shown in FIG. 19 a container 300 on a centrifuge support disk 304. A conduit 308 exits the container on a side farthest from the axis 312 of rotation of the centrifuge disk 304. The disc 304 rotates about the axis 312 in the direction shown by arrows 316. The right-hand 220 is oriented with the thumb 224 in the direction in which the conduit 308 extends above the container 300. The fingers 230 curl in the direction 320 which also defines the direction of rotation of the container 300 about axis 322 as indicated by arrow 324. The right hand rule also applies to a horizontally extending portion 308A of the conduit, as indicated by a second position of the right hand 220A and arrow 320A.

There is shown in FIG. 20 an embodiment in which a container 330 is provided on a centrifuge disk 334 which rotates about an axis 336 as indicated by arrows 342. A conduit 340 exits the container 330 and a portion extends through the plane of the centrifuge support disk 334. In this embodiment the left-hand rule applies and left-hand 340 is oriented with the thumb 344 in the direction in which the conduit 338 exits the container 330. The fingers 348 curl in the direction shown by arrow 352. This defines the direction of rotation of container 330 about axis 354 as indicated by arrow 356. The left hand rule also applies to a portion 340A exiting the container as indicated by the second position of the left hand 340A and arrow 352A.

There is shown in FIG. 21 an embodiment in which a container 380 is oriented orthogonally to a centrifuge disk support 384. The disk support 384 rotates about axis 390 in the direction indicated by arrows 394. Conduit 398 extends from the container 380 to the other (bottom) side of the disk support 384, opposite the side having the container 380. Container rotation is dictated by the left hand rule as indicated by left hand 340. The thumb 344 is oriented in the direction in which the conduit 398 exits the container 380. Fingers 348 curl in the direction indicated by arrow 402 which indicates the desired direction of container rotation as indicated by arrow 406.

There is shown in FIG. 22 an embodiment in which container 410 is provided on a centrifuge to support 414. A conduit 418 extends from the container 410 to another side below the disk support 414. The container 410 is oriented at a 45° angle relative to the centrifuge support disk 414. The centrifuge disk support 414 rotates about an axis 422 in the direction shown by arrows 426. The direction of container rotation about axis 428 is indicated by the left-hand 340 where the thumb 344 is oriented in the direction in which the conduit 418 leaves the container 410. The fingers 348 curl in the direction indicated by arrow 402 and correspond to the desired direction of rotation of the container as indicated by the arrow 430. The left hand rule also applies to a portion 418A of the conduit extending from the container as indicated by second position of the left hand 340A and the arrow 402A.

It is also possible to provide an embodiment in which one conduit extends to one side of the centrifuge support disk and another conduit extends to the other side of the centrifuge support disk. Such an embodiment is shown in FIG. 23. The container 450 is rotatably mounted on a centrifuge support disk 454 which rotates about an axis 458 in the direction indicated by arrows 462. The container rotates about axis 452 and revolves about the axis 458 of rotation of the centrifuge support disk 454. A first conduit 464 extends from one side of the container 450 and to a first side of the centrifuge disk support 454. A second conduit 468 extends from a second end of the container 450 and to the other side of the centrifuge disk support 454. Container rotation is given by the right-hand rule with respect to the conduit 464 extending to the first side of the centrifuge support disk 454, and by the left-hand rule for the conduit 468 extending to the opposite side of the centrifuge support disk 454. The application of these rules to the different conduits leads to the same direction of container rotation. The right-hand 220 is provided with the thumb 224 oriented in the direction which the conduit 464 leaves the container 450. The fingers 230 curl in the direction indicated by the arrow 472 which indicates the desired direction of container rotation so as indicated by arrow 474. The right hand rule also applies to a horizontally extending portion 464A, as indicated by a second position of right hand 220A and arrow 472A. The left-hand 340 is applied to the conduit 468 such that thumb 344 is oriented in the direction in which the conduit 468 leaves the container 450. The fingers 348 curl in the direction indicated by arrow 480 and indicate the desired direction of container rotation as indicated again by arrow 474. The left hand rule also applies to a horizontally extending portion 468A, as indicated by second position of the left hand 340A and the arrow 480A.

Figure 24:
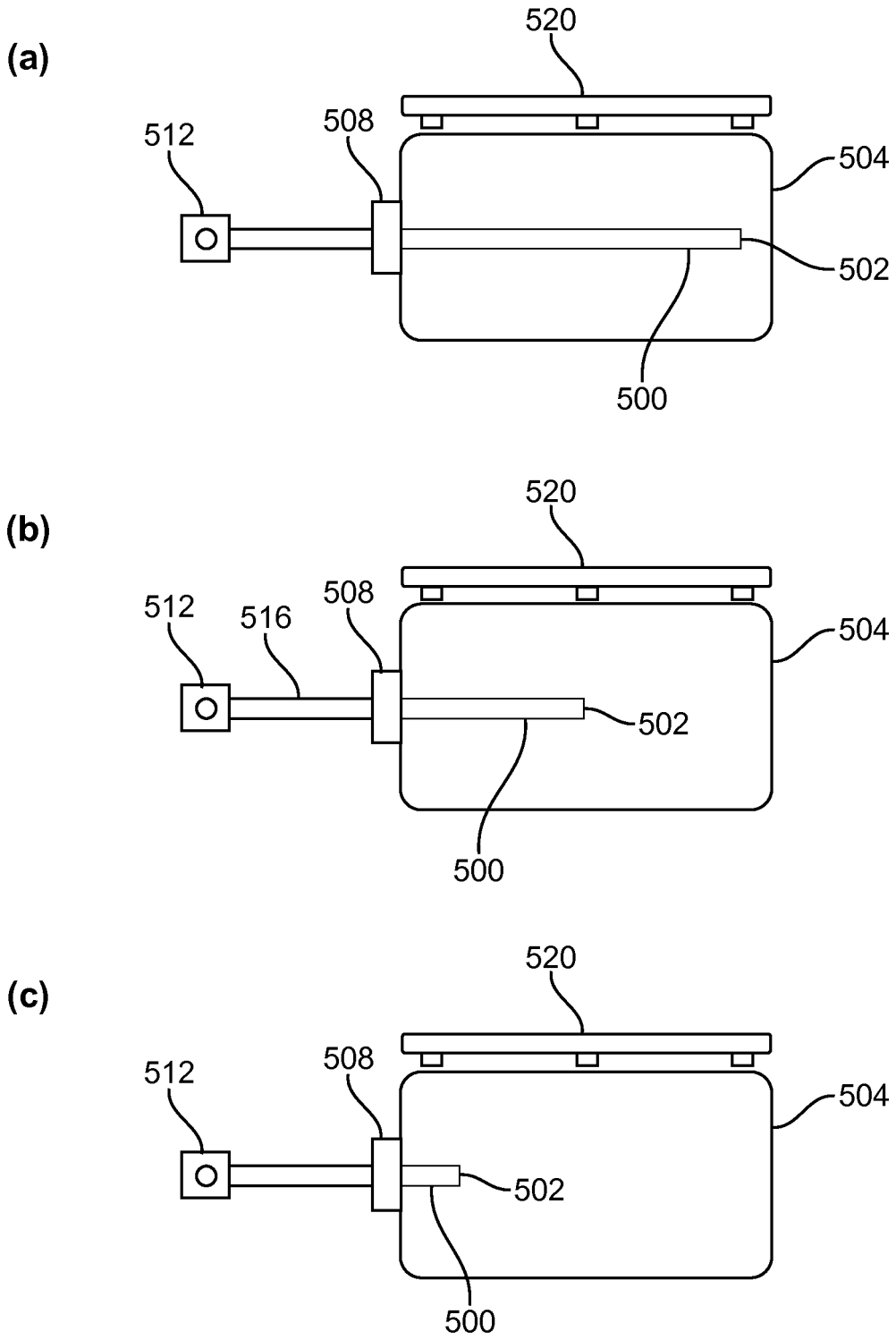
FIG. 24 (*a-c*) is a side elevation of a container with a liquid sensor and single conduit in a a) first; b) second; and c) third conduit position within the container.
Figure 25:
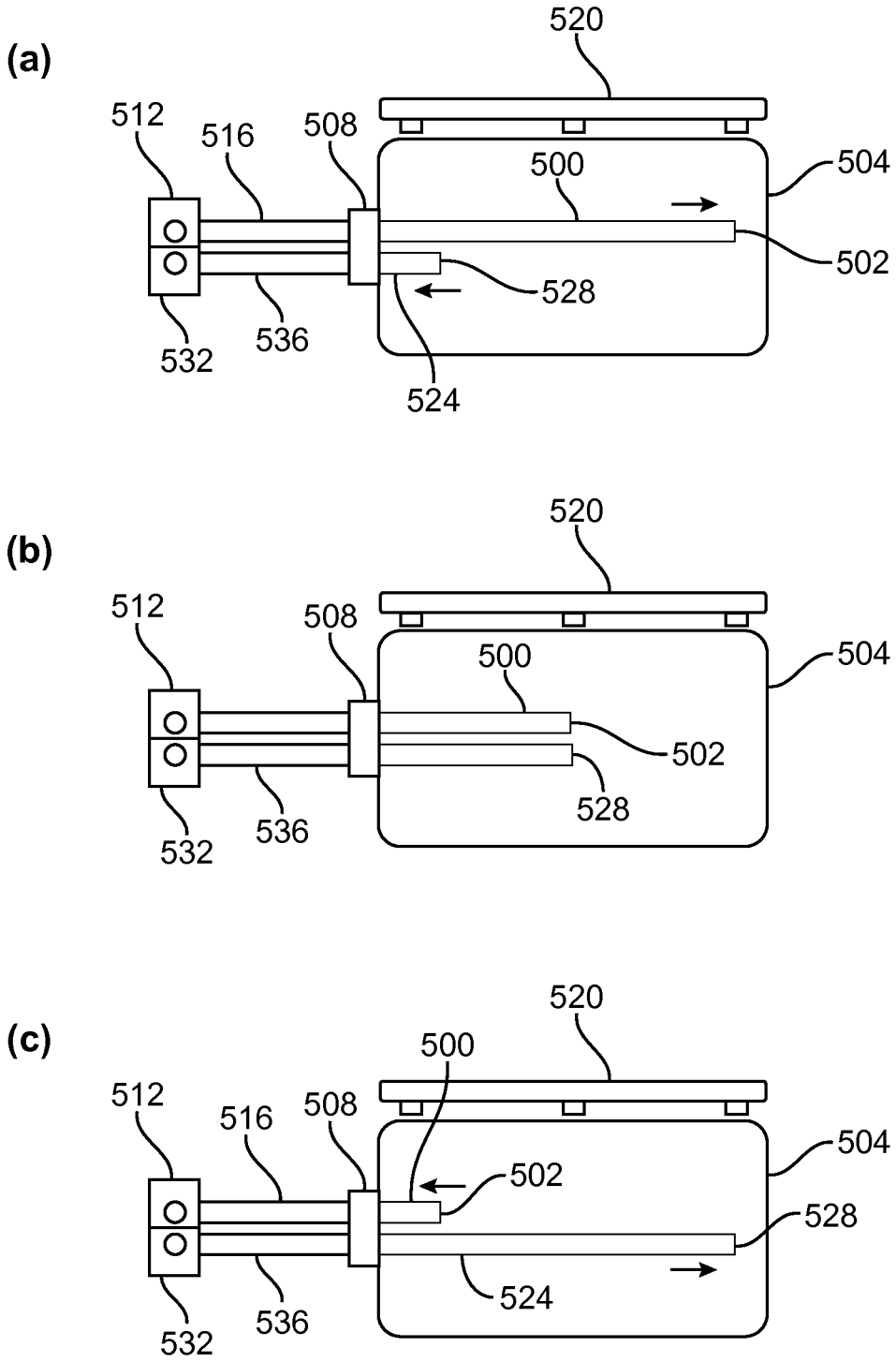
FIG. 25 (*a-c*) is a side elevation of a container having a liquid sensor and first and second conduits in a a) first; b) second; and c) third outlet position within the container.

This size, number, material and position of the conduits into the container can vary. It is also possible that the relative position of the conduits with respect to the container can change. There is shown in FIGS. 24-25 and embodiment in which a single conduit 500 extends into a container 504 through a bearing seal 508. An actuator 512 can communicate with an actuator shaft 516 to alter the position of the conduit 500 and the opening 502 within the container 504. In this manner the position of liquid entering the container 504 or exiting from the container 504 through the opening 502 can be changed depending upon the requirements of the centrifugation that is being performed. Particularly with respect to liquid being removed from the container 504, changing the position of the opening 502 can result in different desired fractions of the centrifugate being removed. This can be performed while the centrifugation is still underway. The opening 502 can be positioned at a radial outward position (a), a middle position (b), or a radial inward position (c), as well as any other position. The actuator 512 can be connected to a suitable processor (not shown) to receive signals so as to properly position the opening 502 for introducing or removing the centrifugation from a desired position depending upon the characteristics of the centrifugation being performed, for example the predicted position of a desired fraction. A sensor 520 can be provided to provide information to the processor for determining an appropriate position of the opening 502 within the container 504. Any suitable sensor 520 is possible, such as an optical sensor or a sensor that is combined with emitter of that which is being sensed, such as light, other radiation, sound waves, magnetic waves, and the like.

There is shown in FIG. 25 an embodiment having first and second conduits which have openings in the container. A second conduit 524 is provided and extends through the bearing seal 508 and has an opening 528. An actuator 532 and actuator shaft 536 can be provided to alter the position of the second conduit 524 and opening 528 within the container 504. The centrifuge sensor 520 can similarly provide information regarding the centrifugate, and this information can be utilized to determine the position of one or both of the first conduit 500 and conduit 524. In one embodiment, one of the conduits can be utilized to supply liquid into the container 504 and another conduit can be utilized to remove liquid from the container 504. The sensor, processor and actuators can be utilized to control the desired relative position of the openings of the conduits, such as the position of the conduit openings supplying liquid to the container 504 and the position of the conduit openings removing the liquid from the container 504. In this manner various liquids including the centrifugation or liquids to assist in material separation can be continuously added to the container 504, and desired fractions within the container 504 can be removed at an appropriate time and position within the container 504.

Figure 26:
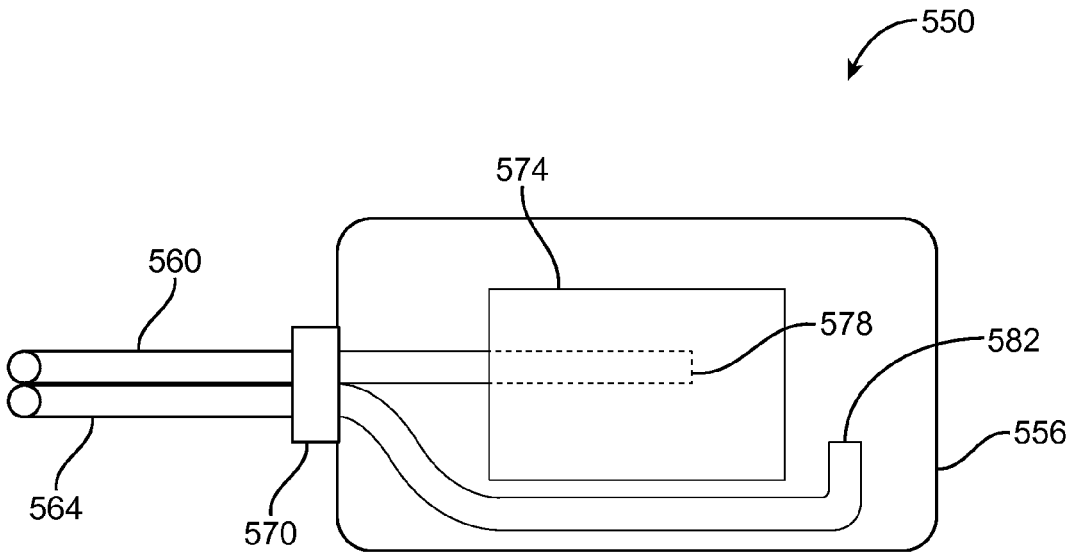
FIG. 26 is a schematic diagram of a separation device according to the invention.

There is shown in FIG. 26 an alternative embodiment of the invention for use in continuous separation processes. The centrifugal separator can include a container and at least one drive (not shown) as described for rotating and revolving the container. The centrifuge container assembly 550 can include a container 556 and a first conduit 560 and second conduit 564 entering the container 556 through a bearing seal 570. A separation device 574 such as a filter or other suitable separation device can be provided within the container 556. An opening 578 of the conduit 560 can be provided on one side of the separation device 574, and an opening 582 of the conduit 564 can be provided on another side of the separation device 574. The frequency of rotation of the container 556 can be equal to the frequency of revolution of the container. Centrifugation fluid can be provided through one of the openings and removed from the container 556 to the other of the openings. This can be performed during the centrifugation process. Accordingly the centrifugation can be coupled with a continuous separation process to effect removal of materials from a centrifugate. The separation device can be any suitable separation device having a material which is selective for separating fluid components in the centrifugation according to at least one characteristic of the centrifugation liquid.

Figure 27:
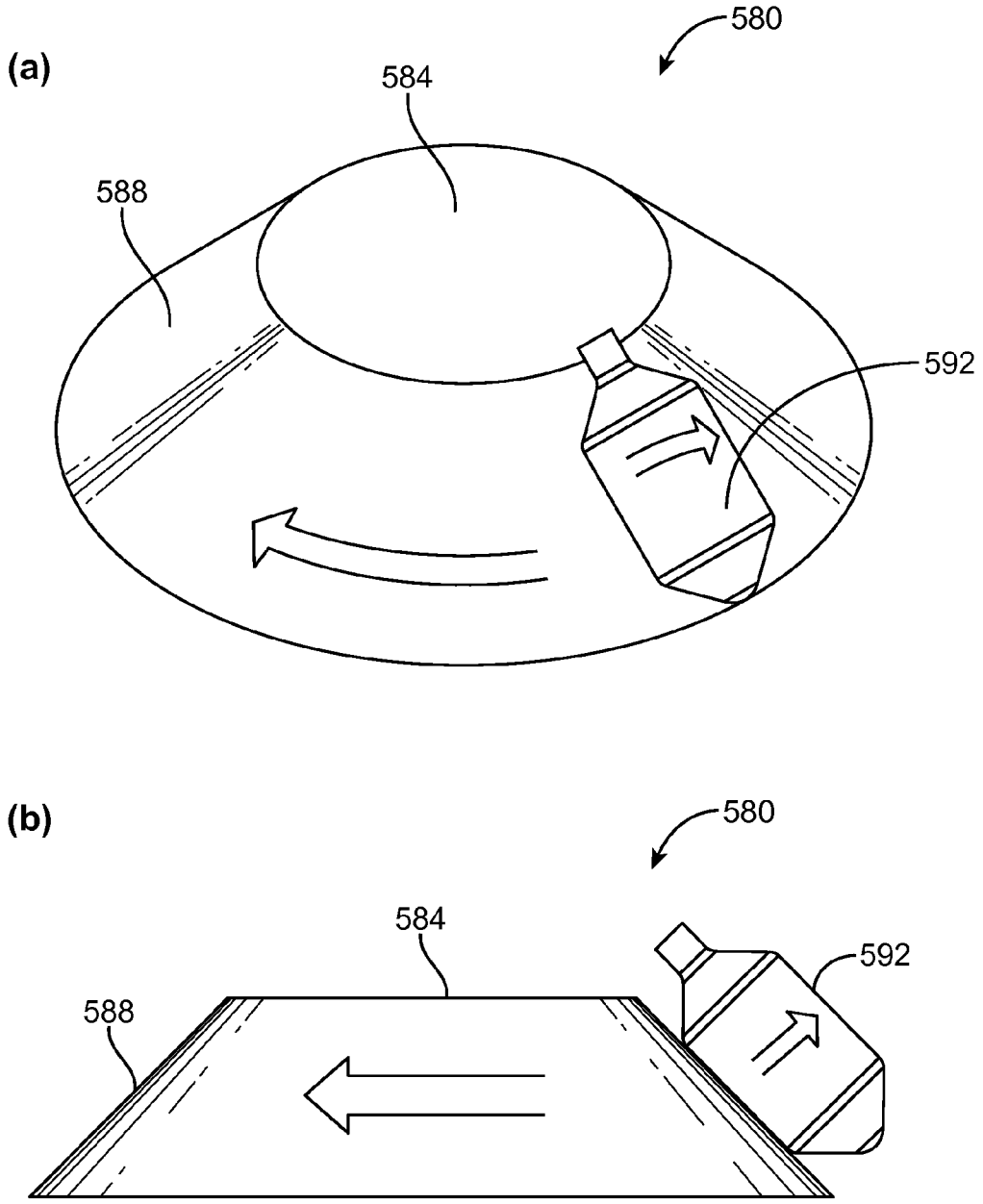
FIG. 27 is a schematic a) perspective and b) side elevation of an alternative embodiment with a beveled container support.
Figure 28:
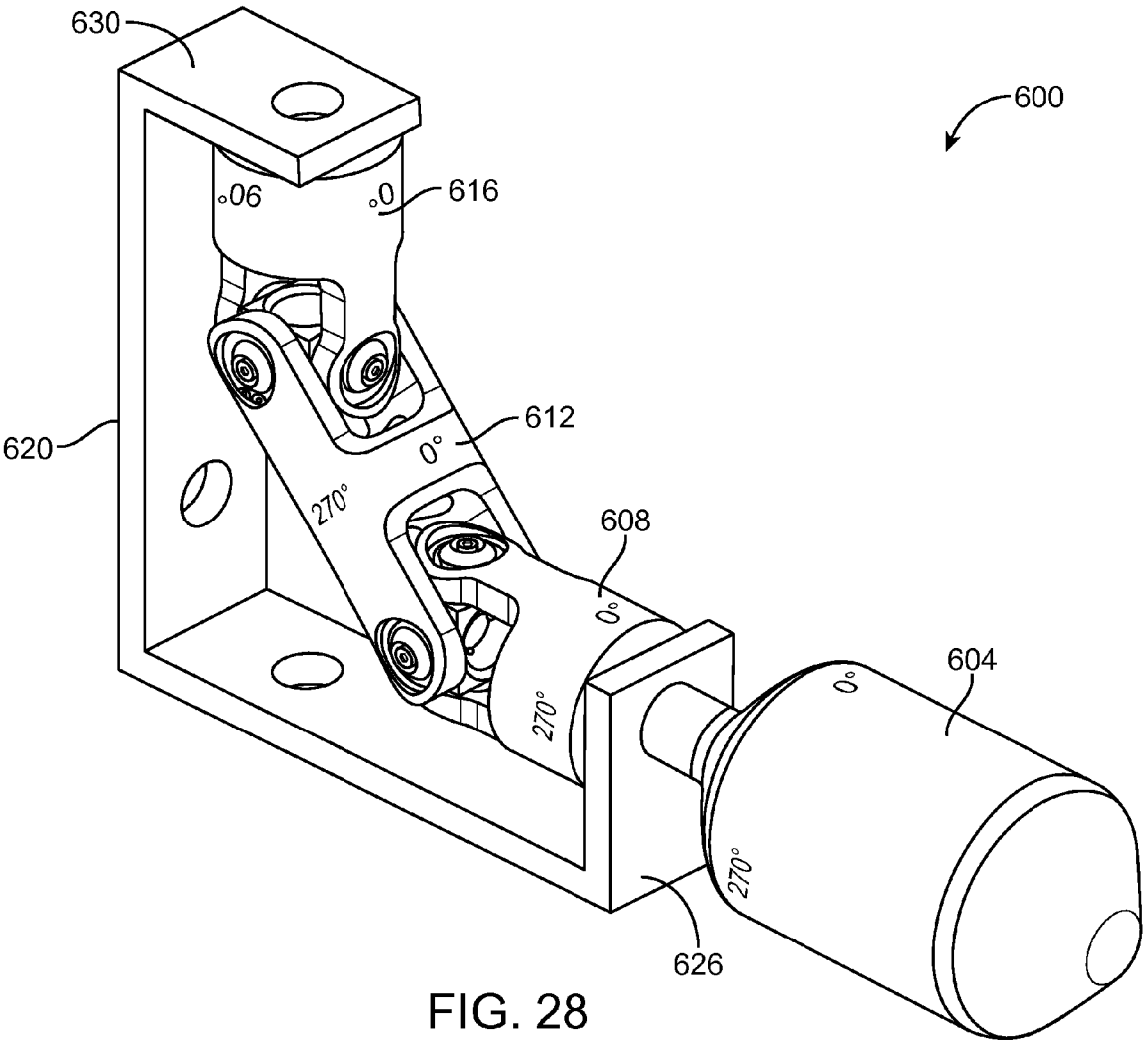
FIG. 28 is a perspective view of a universal joint embodiment of the invention.
Figure 29:
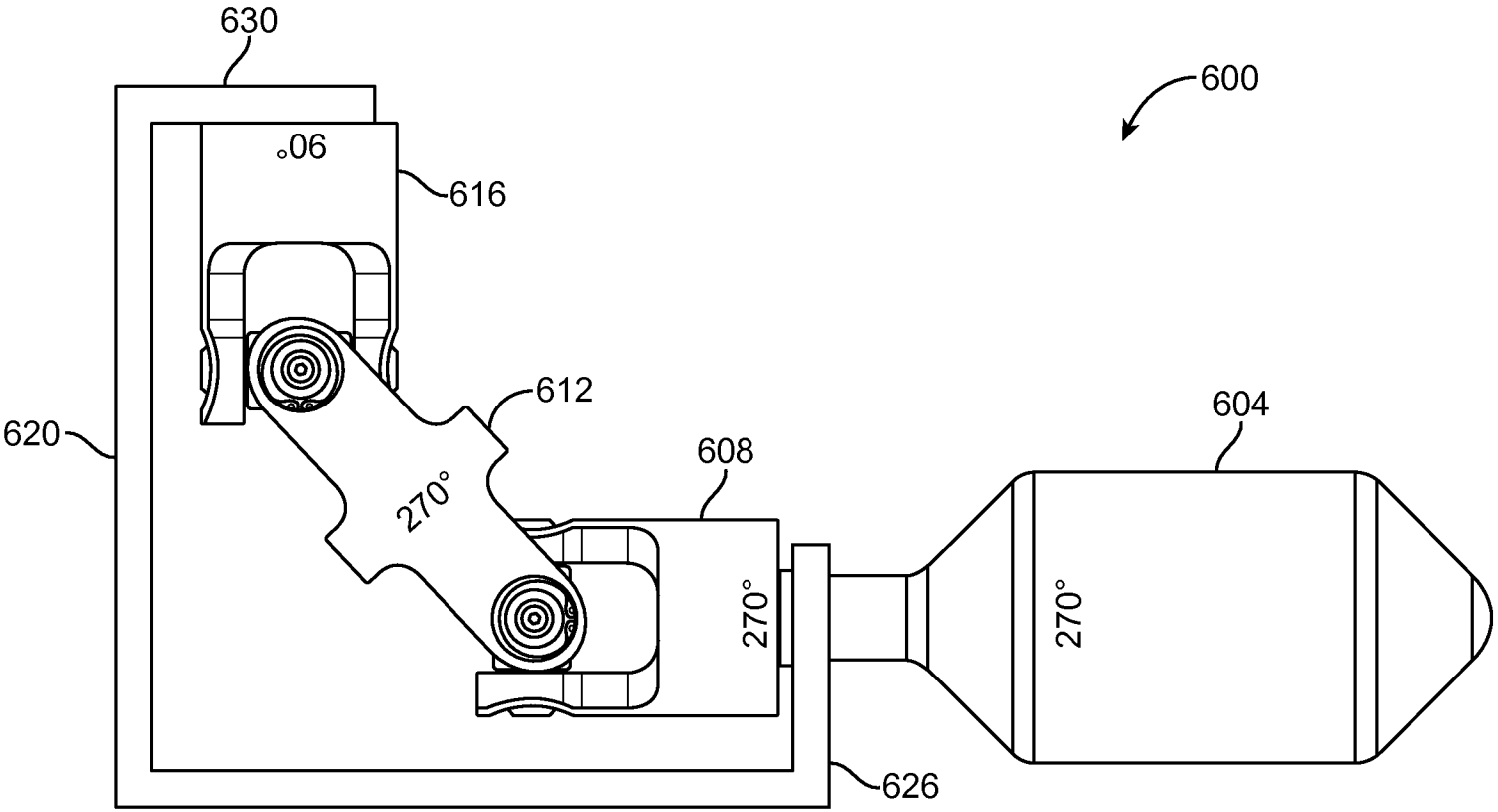
FIG. 29 is a side elevation.

There is shown in FIG. 27 an embodiment 580 in which the centrifuge support 584 includes a beveled surface 588. The container 592 will therefore be at an angle and not horizontal. Any container angle between 0° and 90° is possible. The conduits (not shown) extend outward from the container 592 through the bearing seal and according to the invention will not tangle during centrifugation.

Figure 30:
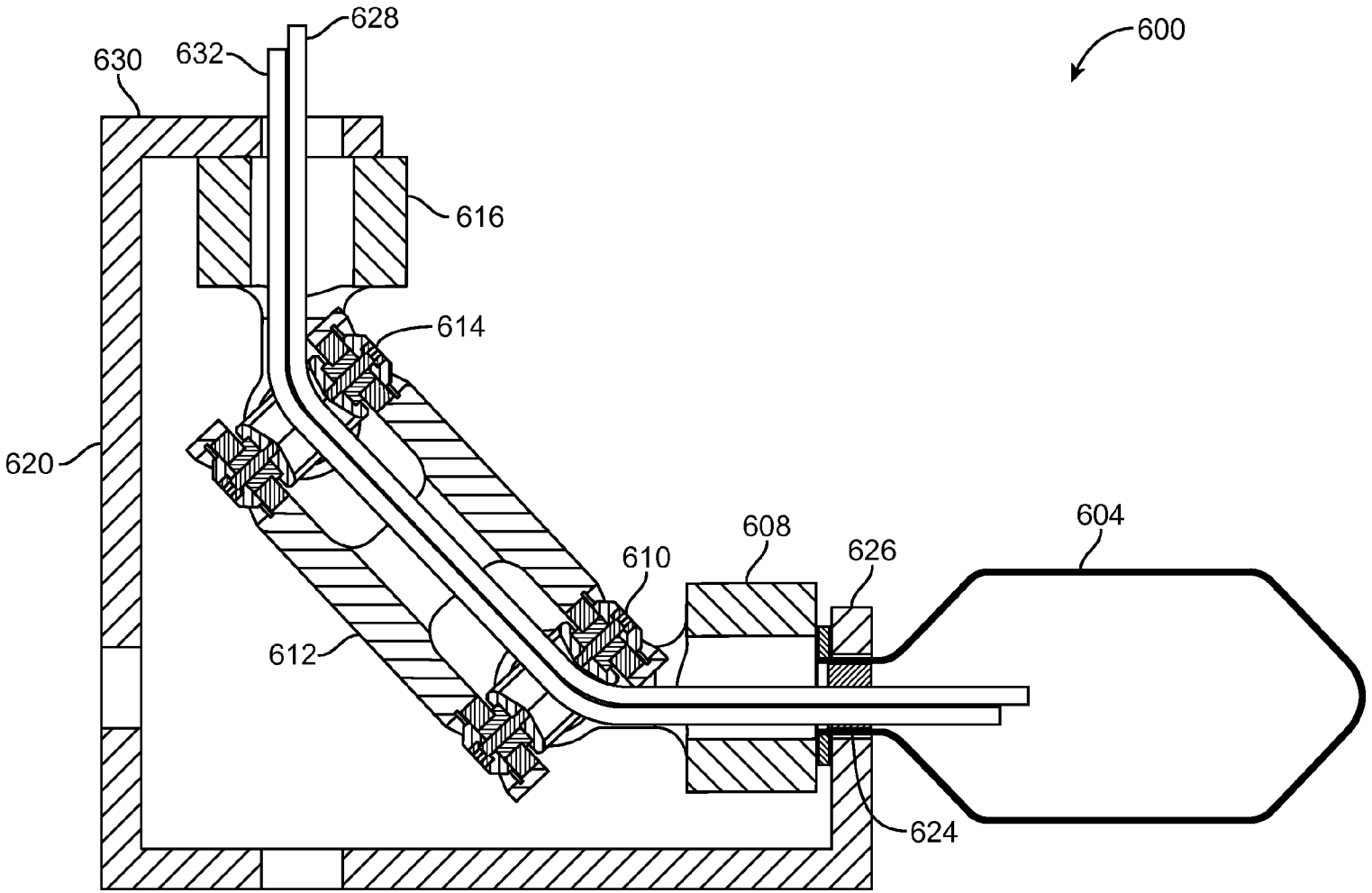
FIG. 30 is a cross-section.
Figure 31:
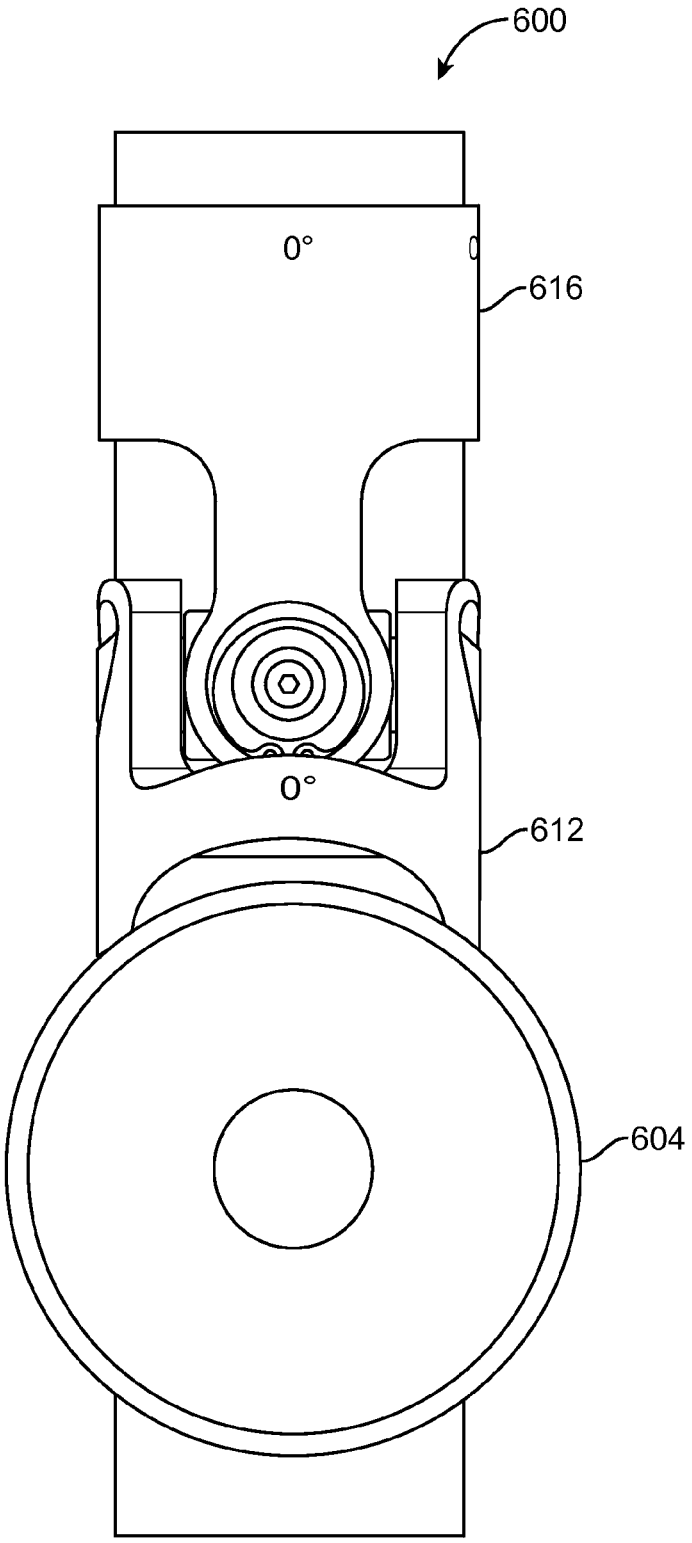
FIG. 31 is a front elevation.
Figure 32:
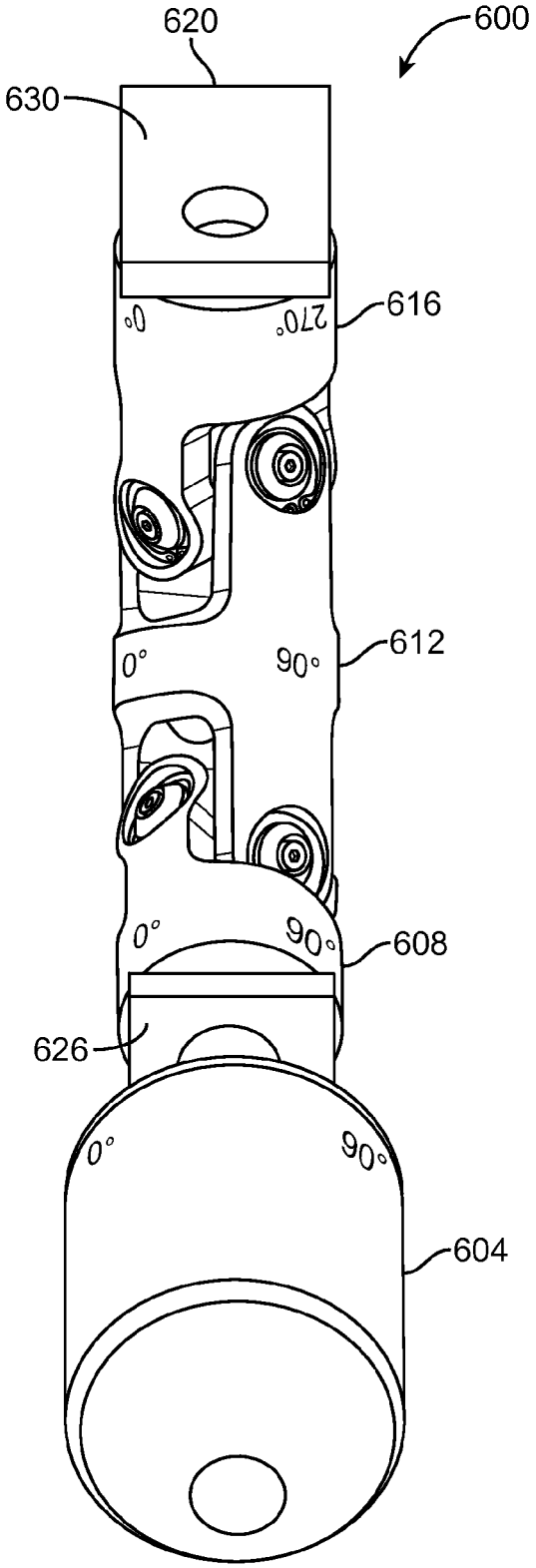
FIG. 32 is a front perspective view.

There is shown in FIGS. 28-36 an embodiment in which the centrifuge container 604 is rotatably mounted to a support and fixedly mounted to a distal end of a double universal joint 600 comprising a distal yolk 608, a rotating shaft 612, and a proximal yolk 616. The proximal yolk 616 of the double universal joint 600 can be fixed in space relative to the rotation and revolution of the container 604. The distal yolk 608 can be joined to the rotating shaft 612 by a universal cross 610. The rotating shaft 612 can be joined to the proximal yolk 616 by a universal cross 614. The direction of a tangent to the rotation of the container 604 is opposite to the direction of a tangent to the revolution of the container, or according to the right hand and left hand rules as previously described. The container 604 is rotatably mounted to a support 620 and fixedly mounted to the distal yolk 608 of the double universal joint 600. A bearing seal 624 can be provided to mount the container 604 to a radial outward end 626 of the support 620 (FIG. 30). The centrifuge can include at least one drive (not shown) for rotating and revolving the container 604. The frequency of the container rotation can be equal to the frequency of the container revolution. The centrifuge can include a first fluid conduit 628 extending into the container 604, and can further include a second fluid conduit 632 extending into the container 604. The first fluid conduit 628 can in one aspect introduce fluid into the container 604, and the second fluid conduit 632 can remove fluid from the container 604.

Figure 33:
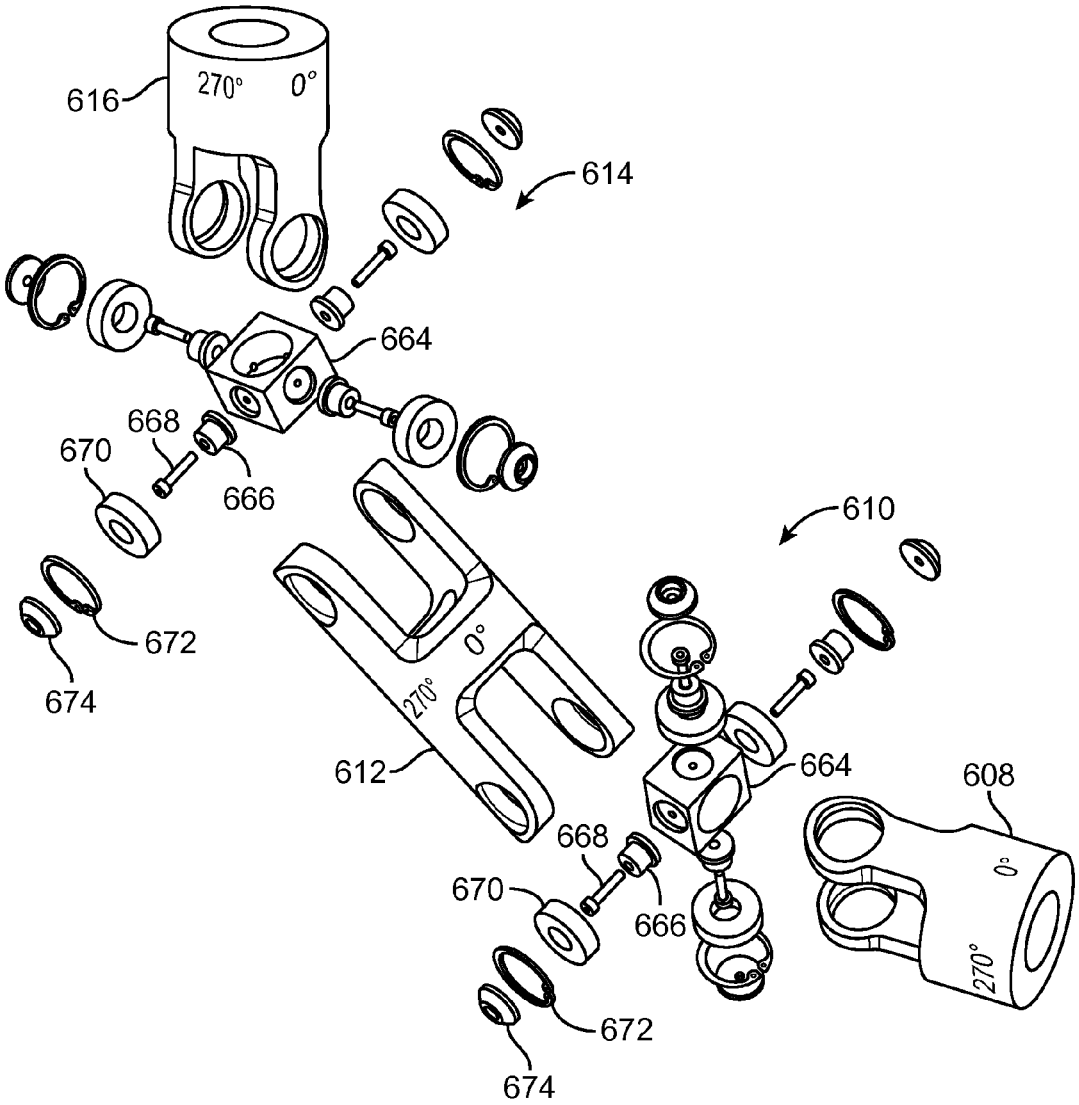
FIG. 33 is an exploded perspective.

The universal cross 610 and 614 can have any suitable construction. The universal cross 610 and 614 can include a spider block 664 (FIG. 33). A spider rotating radius 666 can be engaged to the spider block 664 by pan head bolt 668. A bearing 670 is engaged to the spider block 664 and spider rotating radius 666 by snap ring 672 and bearing cap 674. As is known, the construction of the universal cross permits free pivoting about the spider block 664 of the distal yolk 608 and rotating shaft 612, and by the proximal yolk 616 and rotating shaft 612.

Figure 34:
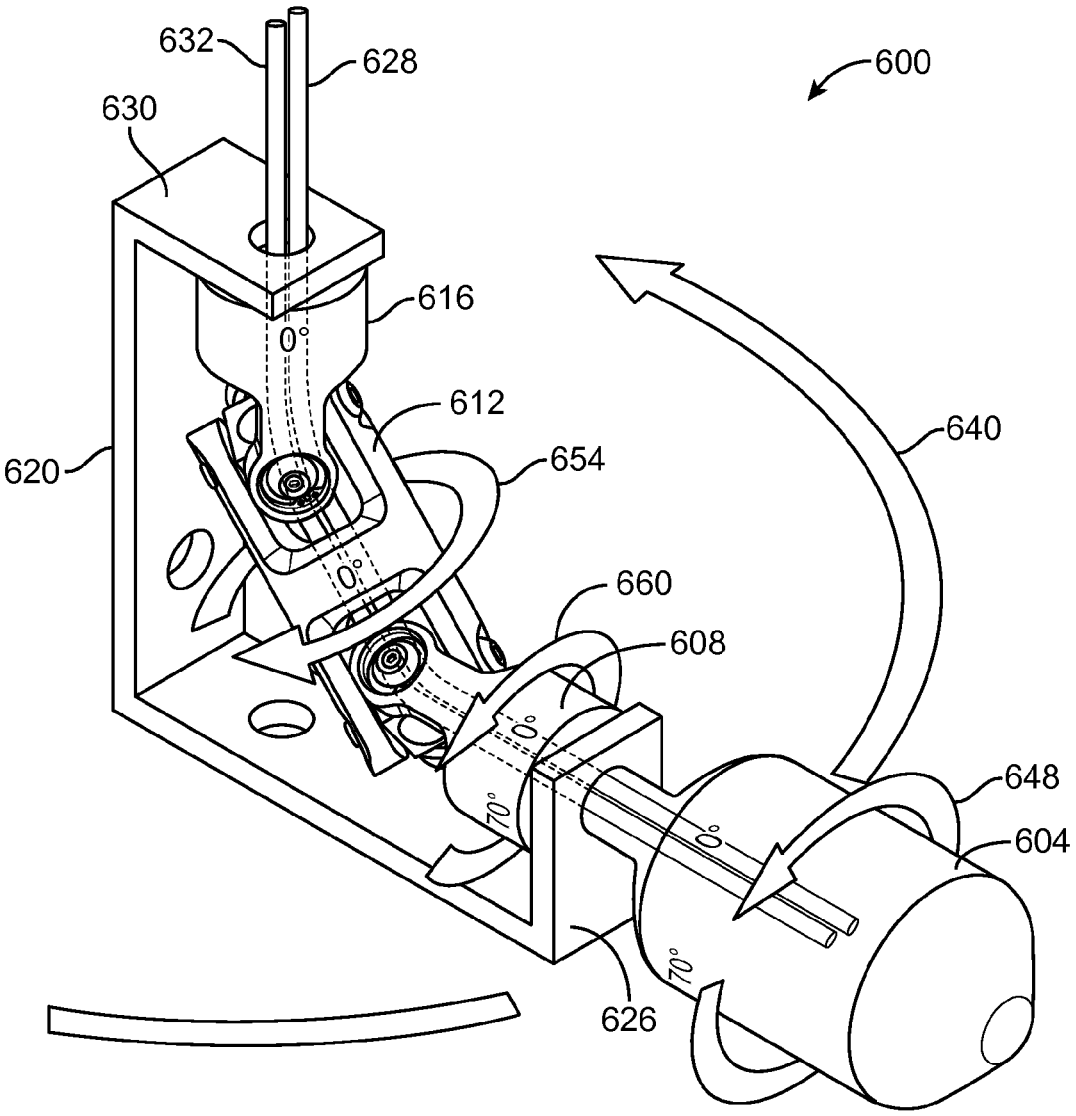
FIG. 34 is a schematic perspective diagram illustrating the operation of the universal joint embodiment.
Figure 35:
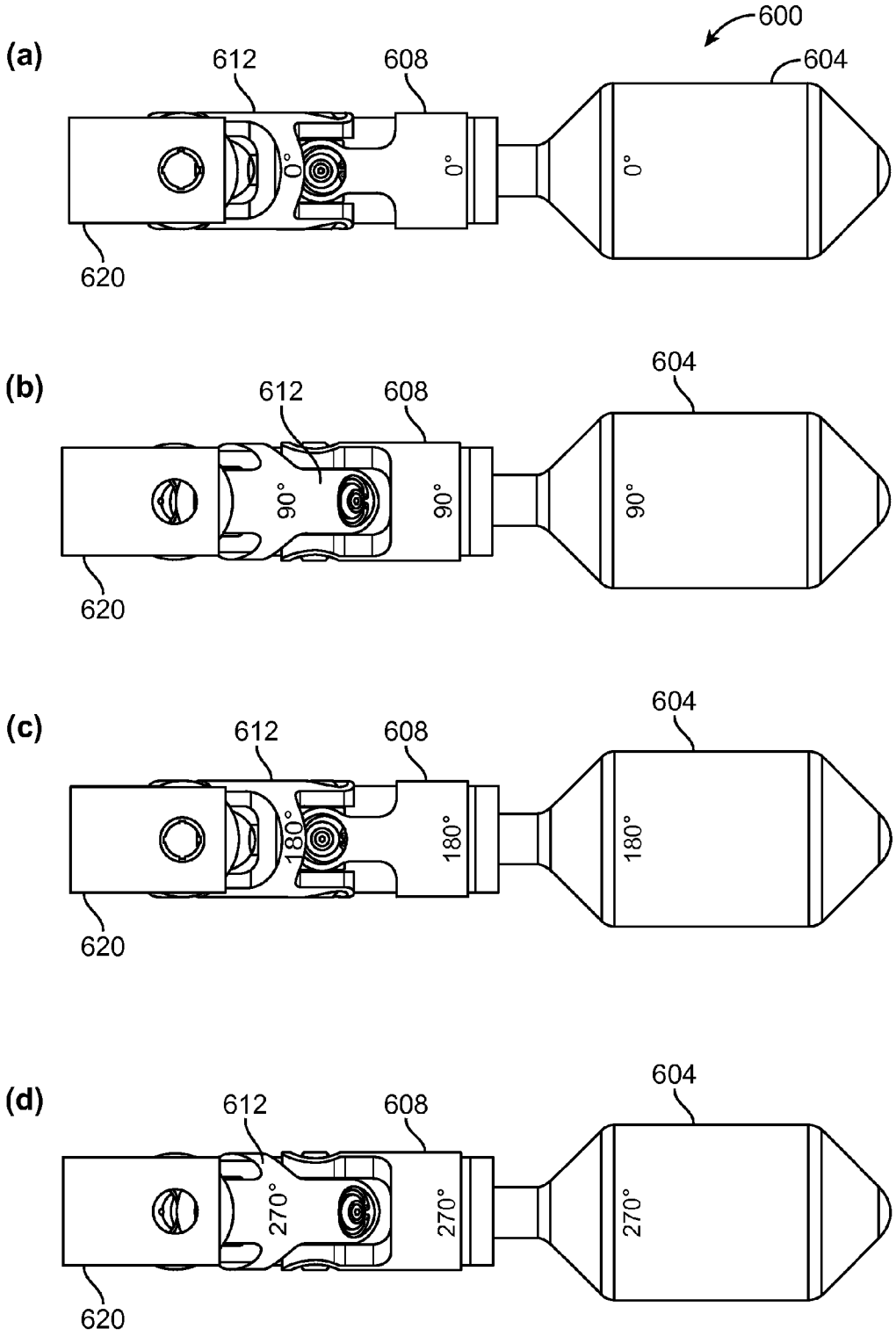
FIG. 35 (*a-d*) a plan view illustrating sequential stages of operation.
Figure 36:
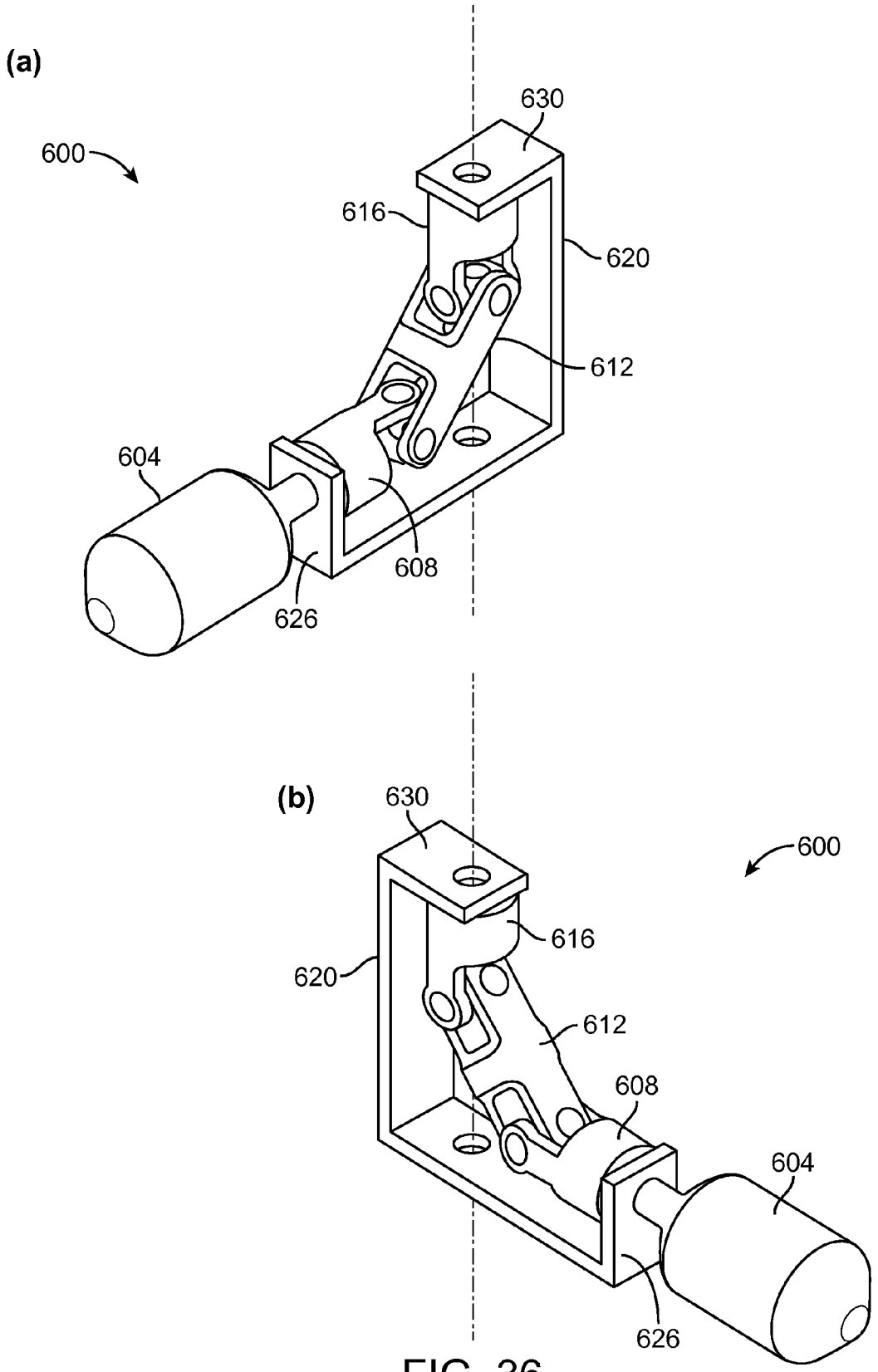
FIG. 36 (*a-b*) is a perspective view illustrating sequential stages of operation

Operation of the universal joint 600 is shown particularly in FIGS. 34-36. The centrifuge support 620 can be mounted to a support plate or disk or otherwise connected to a drive which will rotate the support 620 as indicated by arrow 640. The proximal yolk 616 of universal joint 600 does not move relative to the support 620. The container 604 will rotate in the manner shown by arrow 648, opposite to the direction of revolution of the container indicated by arrow 640. The distal yolk 608 will rotate as indicated by arrow 660. See also FIG. 35 (*a-d*). The rotating shaft 612 will rotate in the manner indicated by arrow 654. The counter rotation of the container 604 relative to the revolution of the container 604 will prevent the conduits 628 and 632 from tangling. This is shown in FIG. 36 (*a-b*). The proximal yolk 616 remains fixed in space relative to the rotation of the support 620 and the container 604.

A centrifuge according to the invention can include a container and at least one drive for rotating the container about its own axis and revolving the container about an axis of revolution and through a plane of revolution. The frequency of the container rotation can be equal to the frequency of the container revolution. At least one conduit extends from the container to a first side of the plane of revolution. The direction of a tangent to the rotation of the container on the first side farthest from the plane of revolution of the container has a direction that is opposite to a tangent to the direction of revolution of the container. The method of centrifuging a fluid can further include the steps of positioning the fluid in a container, and rotating the container about its own axis and revolving the container about an axis of revolution and through a plane of revolution. The liquid can be conducted through at least one conduit extending from the container. The conduit can be positioned on a first or second side of the plane of revolution. The direction of rotation of the container is according to the left hand rule if the conduit extends to the first side of the plane of rotation, and according to the right hand rule of the conduit extends to the second side of the plane of rotation.

This invention can be embodied in other forms without departing from the spirit or essential attributes thereof, and accordingly reference should be made to the following claims to determine the scope of the invention.

We claim:

1. A centrifuge for containers having a container interior, an open end with a container opening and a closed end, comprising:

a rotatable container support, the container support comprising a container holder adapted for engaging the closed end of the container, and at least one drive adapted for rotating the container holder and thereby the container about its own axis and rotating the container support about an axis of rotation and the container about an axis of revolution and through a plane of revolution;

a bearing assembly adapted for supporting and passively and rotatably engaging the open end of the container;

a first fluid conduit adapted for extending from the container to a first or second side of the plane of revolution and a second fluid conduit adapted for extending into the container wherein the first fluid conduit can introduce fluid into the container, and the second fluid conduit can remove fluid from the container:

a removable container seal adapted for engaging the container and sealing the container opening, the container seal comprising openings for placing the first and second fluid conduits in fluid communication with the container interior, the first and second conduits being fluidly connected to the container interior through the container seal openings, the container seal rotating with the container;

wherein the direction of rotation of the container is according to the left hand rule if the conduits extend to the first side of the plane of rotation, and according to the right hand rule if the conduits extend to the second side of the plane of rotation; and, wherein the frequency of the container rotation is equal to the frequency of container revolution.

2. The centrifuge of claim 1, wherein the container support is a plate, and the plane of revolution is defined by the plate.

3. The centrifuge of claim 1, wherein the first and second conduits extend from a first side of a plane of revolution of the container, and a tangent to the rotation of the container on the first side farthest from the plane of revolution of the container has a direction that is opposite to the direction of a tangent to revolution of the container.

4. The centrifuge of claim 1, wherein the first fluid conduit and the second fluid conduit have proximal ends that are fixed in space relative to the rotation and revolution of the container.

5. The centrifuge of claim 1, further comprising a bushing adapted for positioning between the container and the bearing assembly.

* * * * *